United States Patent [19]

Takeuchi

[11] Patent Number: 4,552,051

[45] Date of Patent: Nov. 12, 1985

[54] ELECTRONIC MUSICAL INSTRUMENT WITH KEY TOUCH DETECTOR AND OPERATOR MEMBER

[75] Inventor: Chifumi Takeuchi, Shizuoka, Japan

[73] Assignee: Nippon Gakki Seizo Kabushiki Kaisha, Hamamatsu, Japan

[21] Appl. No.: 545,067

[22] Filed: Oct. 25, 1983

[30] Foreign Application Priority Data

Nov. 2, 1982 [JP] Japan ..... 57-193140

[51] Int. Cl.[4] ..... G10H 1/02

[52] U.S. Cl. ..... 84/1.24; 84/1.27; 84/1.19'1.1

[58] Field of Search ..... 84/1.19, 1.27, 1.1, 84/1.24, 1.26, 1.01

[56] References Cited

U.S. PATENT DOCUMENTS

| | | | |
|---|---|---|---|
| 3,784,718 | 1/1974 | Uchiyama | 84/1.13 |
| 3,819,843 | 6/1974 | Okamoto | 84/1.1 |
| 3,819,844 | 6/1974 | Isii | 84/1.26 |
| 3,965,789 | 6/1976 | Pearlman | 84/1.24 |
| 3,965,790 | 6/1976 | Suzuki et al. | 84/1.27 |
| 4,099,438 | 7/1978 | Hiyoshi et al. | 84/1.25 |
| 4,191,082 | 3/1980 | Koike | 84/1.19 |
| 4,195,545 | 4/1980 | Nishimoto | 84/1.26 |
| 4,217,804 | 8/1980 | Yamaga et al. | 84/103 |
| 4,308,779 | 1/1982 | Suzoki et al. | 84/1.19 |
| 4,391,176 | 7/1983 | Niinomi et al. | 84/1.17 |

*Primary Examiner*—Forester W. Isen

*Attorney, Agent, or Firm*—Spensley Horn Jubas & Lubitz

[57] ABSTRACT

In an electronic musical instrument comprising a keyboard including a plurality of keys, a tone signal generator for producing a musical tone signal corresponding to a depressed key, a key touch detector for generating a key touch signal concerning a key depression operation of the depressed key, and an operator for controlling one of musical tone components of the musical tone signal, there are provided a selector for selecting either one of two control elements comprising the operating state of the operator and the key touch state at the time of key depression for determining whether the degree of control of the musical element caused by the selected control element is to be emphasized or not, and a suppression circuit for inhibiting or suppressing the musical tone control effected by the other control element in accordance with the state of selection of the selector.

25 Claims, 26 Drawing Figures

ELECTRONIC MUSICAL INSTRUMENT WITH KEY TOUCH DETECTOR AND OPERATOR MEMBER

BACKGROUND OF THE INVENTION

This invention relates to an electronic musical instrument with a key touch detector and an operator member and particularly an electronic musical instrument of the type wherein when such musical tone elements as the pitch, color and volume of a musical tone generated are controlled by two control elements including a key touch state and the operating state of an expression pedal or the like.

In a prior art electronic musical instrument, among various musical tone elements including the pitch, color and volume of a generated musical tone, the volume, for example, was controlled by both of (1) The operating state of an expression pedal, and (2) The key touch state at the time of key depression.

With such electronic musical instrument, it is possible to perform overall control of the tone volume of the performed tone by the operating state of the expression pedal and to control the volume of the performed tone for each depressed key unit by the key touch state.

However, in the prior art electronic musical instrument, since the two control elements are independent of each other, where it is desired to obtain a performance rich in musical expression by emphasizing the volume control of the musical tone with the key touch state, for example, it is necessary to decrease the degree of volume control of the musical tone corresponding to the operating state of the expression pedal or to make extremely strong (or fast) the key touch state. As a consequence, it is necessary to make different the performance operation depending upon whether the degree of control of one control element should be emphasized or not which requires a skillful performance operation.

SUMMARY OF THE INVENTION

It is therefore an object of this invention to provide a novel electronic musical instrument capable of emphasizing the degree of control of one control element by the same performance operation irrespective of whether the degree of control of the one control element is emphasized or not, where musical tone elements are controlled with two control elements including the operating state of such operator as an expression pedal, needle lever, tone volume etc., and the key touch state.

Briefly stated, according to this invention, among two control elements including the operating state of an operator member and the key touch state at the time of key depression, selection means is provided for one control element for selecting whether the degree of control of the musical tone element effected by the one control element should be emphasized or not. Another means is provided to prevent or suppress the musical tone control effected by the other control element in accordance with the state of selection of the selection means.

According to this invention there is provided an electronic musical instrument comprising keyboard means including a plurality of keys, tone signal generating means for producing a musical tone signal corresponding to a depressed one of said plurality of keys, a key touch detector for generating a key touch signal concerning a key depression operation of said depressed key, an operator member for controlling one of musical tone components of said musical tone signal, operator detection means for generating an operator detecting signal concerning said operator member when it is operated, designating means for designating either one of said key touch signal and said operator detecting signal to be suppressed, suppression circuit means for suppressing the signal designated by said designating means, an output of which being used to modify said musical tone signal outputted from said tone signal generating means, and a sound system for producing a musical tone corresponding to said modified musical tone signal.

DESCRIPTION OF THE PREFERRED EMBODIMENTS

Figure 1:
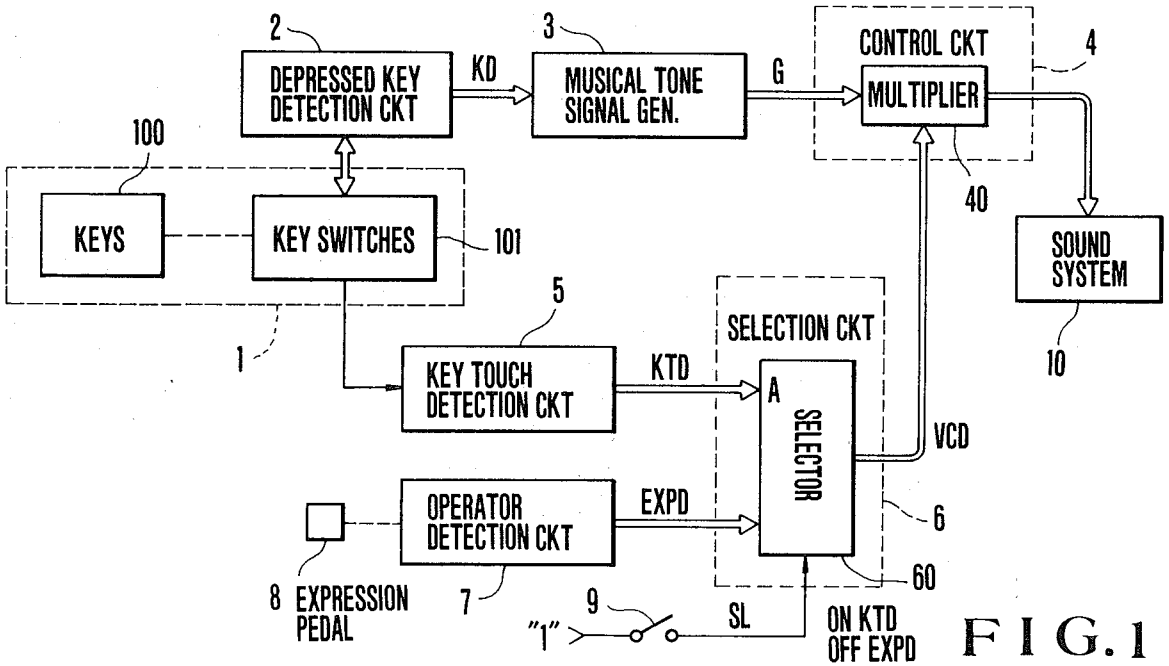
FIGS. 1 and 2 are block diagrams showing the basic construction of this invention.

FIGS. 1 an 2 show basic construction of this invention.

In FIG. 1, expression pedal is used as an operator member for controlling the musical tone elements of a musical tone signal so as to control the musical tone by two control elements including the operating state of the expression pedal and the key touch state at the time of key depression. The circuit is constructed such that the control of the musical tone by the expression pedal is prevented, when it is desired to emphasize the degree of control of the musical tone by the key touch.

Figure 2:
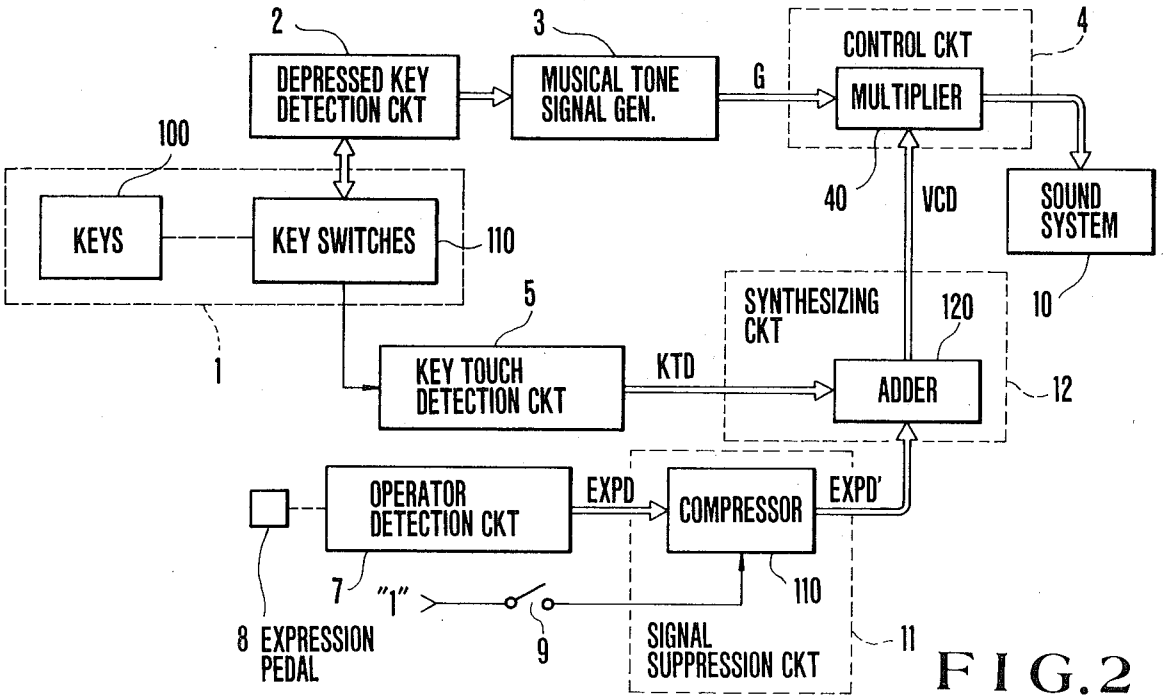

The circuit shown in FIG. 2 is constructed such that when it is desired to emphasize the degree of control of the musical tone by key touch, the degree of control of the musical tone by the operation of the expression pedal is suppressed.

In FIG. 1, a keyboard unit 1 is provided with a plurality of keys 100 over a predetermined tone range and key switches 101 corresponding to respective keys. When either one of the keys 100 of the key unit 1 is depressed a key detection circuit 2 detects the depressed key of the keyboard unit 1 to produce a key code KD representing the depressed key. The key code KD is constituted by a code information or a digital information corresponding to the tone pitch of the depressed key and supplied to a musical tone signal generator 3.

The musical tone signal generator 3 may be of any one of the well known types including waveform memory read out type, harmonic wave synthesizing type, frequency (or amplitude) modulation type, and synthesizer type. When supplied with a key code KD representing the depressed key form the depressed key detection circuit 2, the musical tone signal generator 3 forms a musical tone signal G corresponding to the key code KD and sends this signal G to a control circuit 4.

A key touch detection circuit 5 is provided to detect such key touch as the depression strength or speed of a depressed key of the keyboard unit 1 by the operation of a key switch 101 corresponding to the depressed key for outputting to the key touch information KTD. The key touch information KTD is sent to a selection circuit 6. The key touch detection circuit 5 is well known and is described, for example, in U.S. Pat. Nos. 3,784,718 dated Jan. 8, 1974, 3,819,843 dated June 25, 1974, 3,965,789 dated June 29, 1976 and 4,099,438, dated June 11, 1978.

An operator detection circuit 7 detects the operation state of an expression pedal 8 for producing an expression information EXPD corresponding to the operation state, which is supplied to the selection circuit 6. The operator detection circuit 7 is also well known as disclosed in U.S. Pat. No. 3,965,790 dated June 29, 1976, for example.

In response to the selection state (ON/OFF) of the seletion switch 9 which is operated when the degree of control of the musical tone effected by the key touch operation, the selection circuit 6 selects either one of the key touch information KTD and the expression information EXPD and supplies the selected information to the control circuit 4 as a volume control information VCD of the musical tone signal G. The selection circuit 6 is constituted by a selector 60 which selects the key touch information KTD when the selection control signal SL becomes "1" as the result of closure of selection switch 9, whereas selects the expression signal EXPD when the selection control signal SL becomes "0" as the result of opening of selection switch 9.

Thus, the selection circuit 6 selects the key touch information KTD and sends out the same as the volume control information VCD when the selection switch 9 is ON, whereas selects the expression information EXPD and outputs the same as the volume control information VCD when the selection switch 9 is OFF. In other words, the selection circuit 6 acts as a gate circuit.

The control circuit 4 comprises a multiplier 40 which multiplies the musical tone signal G with the volume control information VCD supplied from the selection circuit 6 so as to control the tone volume of the musical tone signal G to produce a musical tone from a sound system 10.

Thus, the tone volume of the musical tone signal G is controlled by the key touch information KTD alone when the selection switch 9 is ON whereas only by the expression information EXPD when the selection switch 9 is OFF.

Consequently, when the selection switch 9 is ON, the volume of the musical tone can be controlled (emphasized) corresponding to the key touch state irrespective of the operating state of the expression pedal 8. In other words, when the selection switch 9 is closed, as the control of the volume of the musical tone by the expression information EXPD is prohibited, even when the expression pedal 8 is operated in the same manner as in a case wherein the degree of control of the volume of the musical tone is not emphasized by the key touch state, the volume of the musical tone varies following the variation of the key touch state so that degree of control of the volume of the musical tone would be emphasized in accordance with the key touch state.

When the selection switch 9 is OFF, the volume of the musical tone varies following the operation state of the expression pedal 8 regardless of the key touch state with the result that the degree of control of the volume of the musical tone would be emphasized in accordance with the operation state of the expression pedal 8.

In this manner, with the construction shown in FIG. 1, it is possible to emphasize the degree of control of the volume of the musical tone effected by the key touch state by a simple operation of closing the selection switch 9.

The circuit shown in FIG. 1 may be modified such that the control of the volume of the musical tone effected by the expression pedal 8 is emphasized by closing the selection switch 9.

Instead of completely inhibiting the musical tone control effected by the operation state of the expression pedal 8 when the selection switch 9 is ON, as shown in FIG. 2, the circuit is modified such that the expression information is suppressed and that the musical tone volume is controlled by the suppressed expression information EXPD and the key touch information.

More particularly, only when the selection switch 9 is suppressed to a suitable value by a compressor 110 that constitutes a signal suppression circuit 11, the suppressed expression information EXPD' and the key touch information KTD are added together by an adder 12 constituting a synthesizing circuit 12 so as to supply the sum information (KTD+EXPD') to the control circuit 4 as a volume control information.

With the construction shown in FIG. 2, when the selection switch 9 is OFF, the expression information EXPD is not varied so that the musical tone volume is controlled in accordance with the combination of the key touch state and the operation state of the expression pedal 8 as in the prior art electronic musical instrument. However, when the selection switch 9 is closed, as the expression information EXPD is suppresed by compressor 110 by a predermined ratio, the degree of volume control effected by the key touch information KTD would be emphasized in accordance with the ratio of suppression of the expression information.

With the construction shown in FIG. 2, by determining the ratio of signal suppression effected by the compressor 110 according to the state of selection of the color or the effect of the musical tone, for example, it is possible to make optimum the degree of emphasis of the musical tone control effected by the key touch state.

Figure 3:
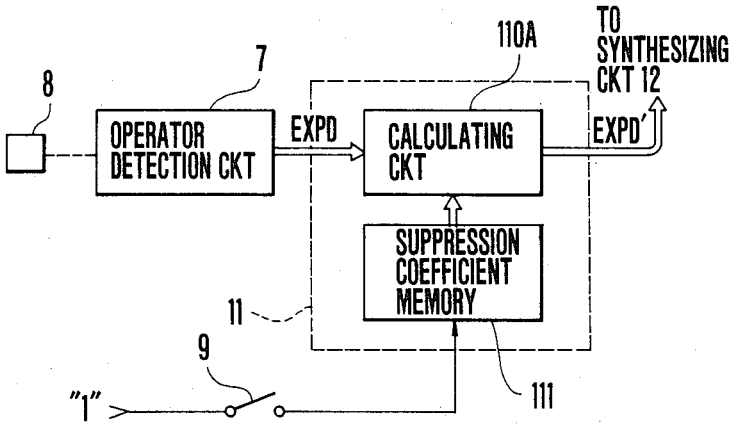
FIG. 3 is a connection diagram showing a modification of the signal suppression circuit shown in FIG. 2.

As shown in FIG. 3, the suppression circuit 11 shown in FIG. 2 can be substituted by a combination of a calculating circuit 110A and a suppression coefficient memory device 111. More particularly, by the operation of the expression pedal 8, the expression information EXPD from the operator detection circuit 7 is sent to the calculating circuit 110A which is also supplied with the output of the suppression coefficient memory device 111. The output of this memory device 111 is varied by ON and OFF of the selection switch 9 so as to supply different suppression coefficients to the calculating circuit 110A. Consequently, the calculating circuit 110A calculates the expression information EXPD and the suppression coefficient for sending an expression information EXPD' to the synthesizer circuit 12. The calculating circuit 110A can be substituted by a multiplier.

Figure 4:
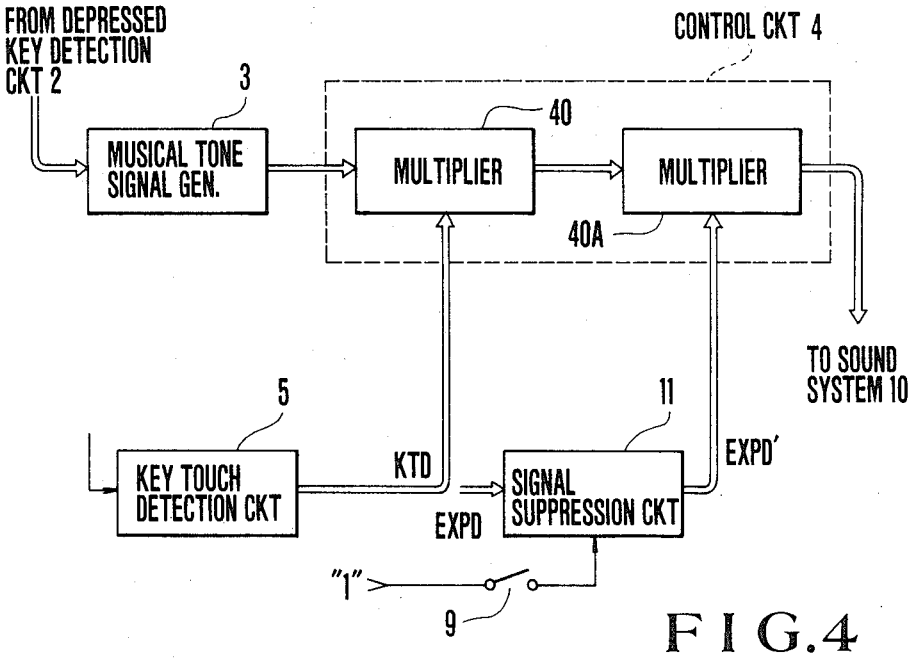
FIG. 4 is a connection diagram of a circuit that can be used as the synthesizing circuit shown in FIG. 2.

In the circuit shown in FIG. 2, instead of providing the synthesizing circuit 12, another multiplier 40A may be connected in series with the multiplier 40 of the control circuit 4 and the key touch information KTD and the expression information EXPD' may be directly applied to these two multipliers 40 and 40A. This construction is shown in FIG. 4.

When the construction shown in FIG. 1 or 2 is applied to an electronic musical instrument including a plurality of musical tone signal generating system an ensemble effect can be realized by a simple performance operation.

Figure 5:
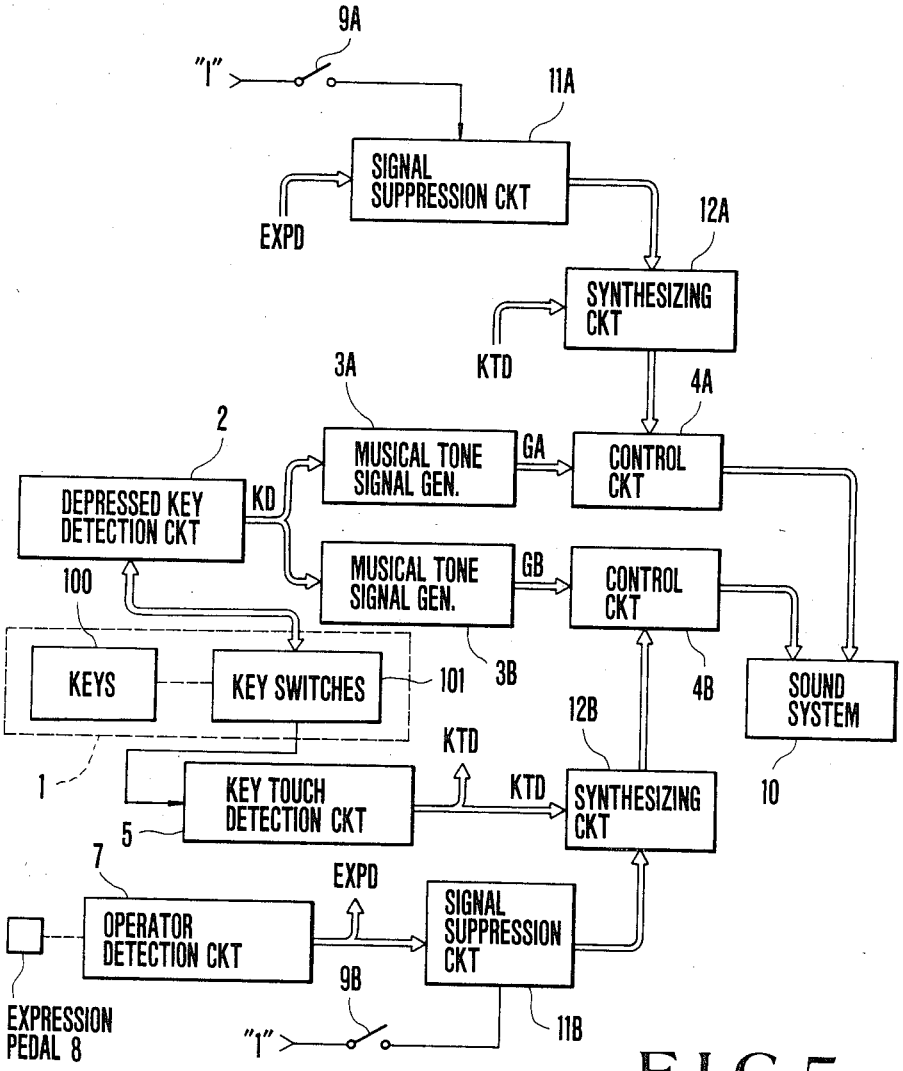
FIG. 5 is a block diagram showing one example of the application of the basic construction shown in FIG. 1.

More particularly, as shown in FIG. 5, a circuit identical to that shown in FIG. 2 is provided on the output side of two musical tone signal generators 3A and 3B. Thus, the volume of the musical tone signal G produced by the first musical tone signal generator 3A is controlled by a circuit comprising control circuit 4A, selection switch 9A, signal suppression circuit 11A and a synthesizing circuit 12A based on the output informations KTD, EXPD of key touch detector 5 and operator detection circuit 7. The tone volume of the musical tone signal produced by the second musical tone signal generator 3B is controlled by a circuit comprising control circuit 4B, selection switch 9B, signal suppression circuit 11B and synthesizing circuit 12B based on the outputs KTD, EXPD of key touch detection circuit 5 and operator detection circuit 7.

With the circuit shown in FIG. 5, when only the switch 9A of the first system is closed, the tone volume of the musical tone signal GA generated by the musical tone signal generator 3A, for example, a tone signal of a piano varies following mainly the key touch state on the keyboard unit 1. On the other hand, the tone volume of the musical tone signal GB generated by the musical tone signal generator 3B of the second system, for example a tone signal of an organ, varies in accordance with a combination of the key touch state and the operation state of the expression pedal 8.

Consequently even when one performer performs with the keyboard unit 1, of the tones of piano and organ, the volume of the tone of the piano is especially emphasized in accordance with the key touch state, thus realizing an ensemble effect in which the piano tone is more remarkable than the organ tone.

In the circuit shown in FIG. 5, even when the selection switch 9B, signal suppression circuit 11B and synthesizing circuit 12B of the second system are eliminated so as to control the volume of the musical tone signal GB of this system only by the output information from the operator detection circuit 7, a similar ensemble effect can be provided by closing the selection switch 9A. Thus, the desired ensemble effect can be obtained by providing the circuit for emphasizing the degree of controlling the volume effected by the key touch state for only one musical tone signal generating system.

Figure 6:
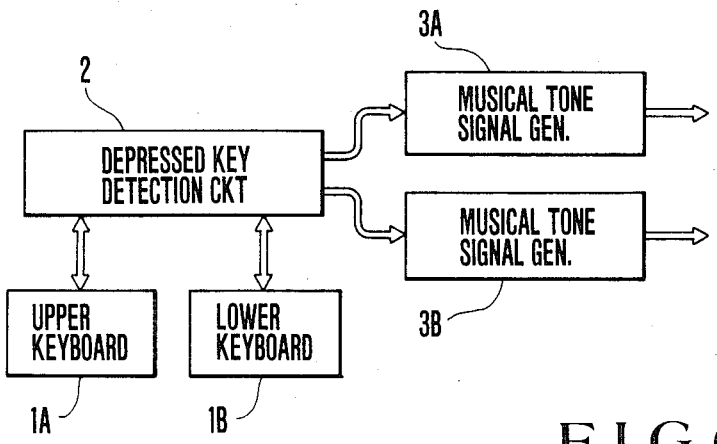
FIGS. 6 and 7 are block diagrams showing other examples of the musical tone generating system shown in FIG. 3.
Figure 7:
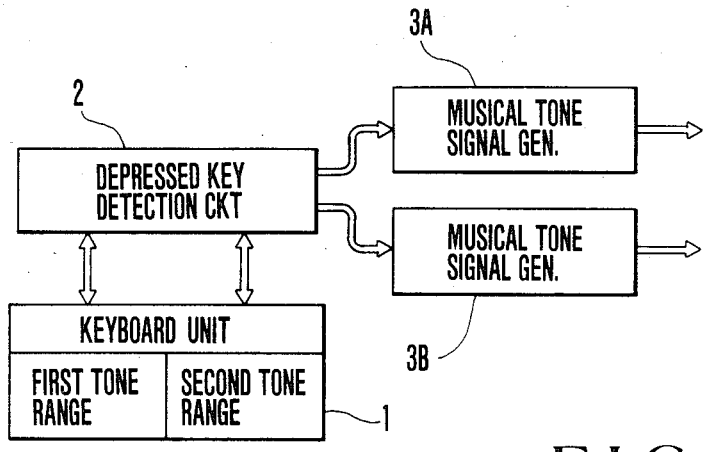

The plurality of the musical tone signal generating systems are used to generate musical tone signals having different musical tone elements as the tone, color, effect and pitch. Instead of providing a pluralily or musical tone signal generators for one keyboard unit as shown in FIG. 5, two musical tone signals 3A and 3B may be produced by two keyboard units including a upper keyboard unit 1A and a lower keyboard unit 1B, as shown in FIG. 6 so as to detect the depressed keys of the respective keyboard units 1A and 1B by the depressed key detection circuit 2, thereby generating a musical tone signal corresponding to the upper keyboard unit 1A from the first musical tone signal generator 3A, and a musical tone signal corresponding to the depressed key of the lower keyboard unit 1B from the second musical tone signal generator 3B. Furthermore, as shown in FIG. 7, the circuit can be modified such that the keys of a single keyboard 1 may be divided into a first tone range and a second tone range so as to generate the musical tone signal corresponding to the depressed key of the first tone range from the first musical tone signal generator 3A and to generate the musical tone signal corresponding to the depressed key of the second tone range from the second tone signal generator 4A.

Although in the foregoing description an expression pedal was used as the operator, it will be clear that other manual operator elements as a knee lever and a tone volume can also be used.

Figure 8:
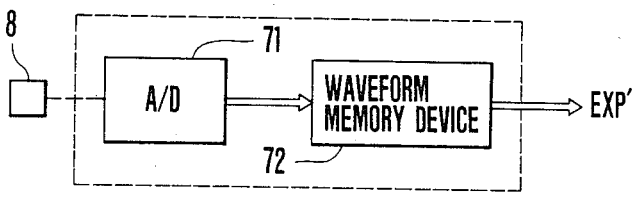
FIG. 8 is a block diagram showing a modified operator detection circuit.
Figure 9:
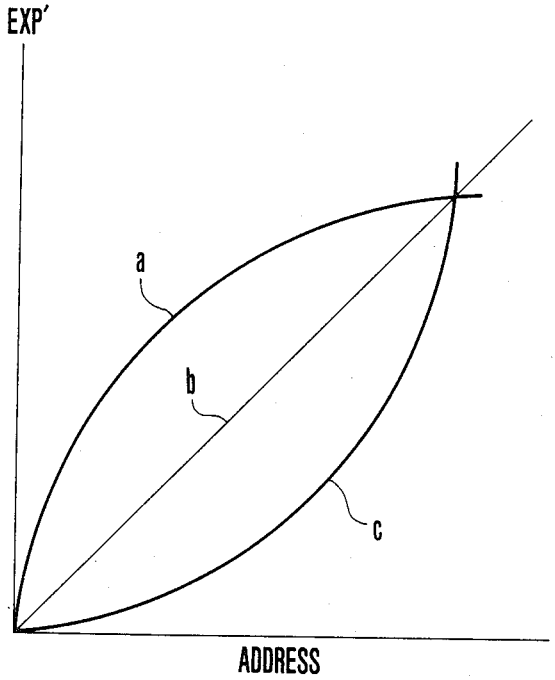
FIG. 9 shows typical waveforms stored in the waveform memory device shown in FIG. 8.

As shown in FIG. 8, the operator detection circuit 7 may be constructed such that a signal from the operator 8 is applied to a waveform memory device 72 via an analogue digital converter 71 to act as an address signal so that the memory device 72 sends out as the EXP information EXP' the data stored in an address designated by the address signal. The waveform memory device 72 is prestored with one of the waveforms shown by characteristics a, b and c shown in FIG. 9 so as to send out as the expression information EXP' the data stored in the address designated by the address signal outputted from the A/D converter 71.

Figure 10:
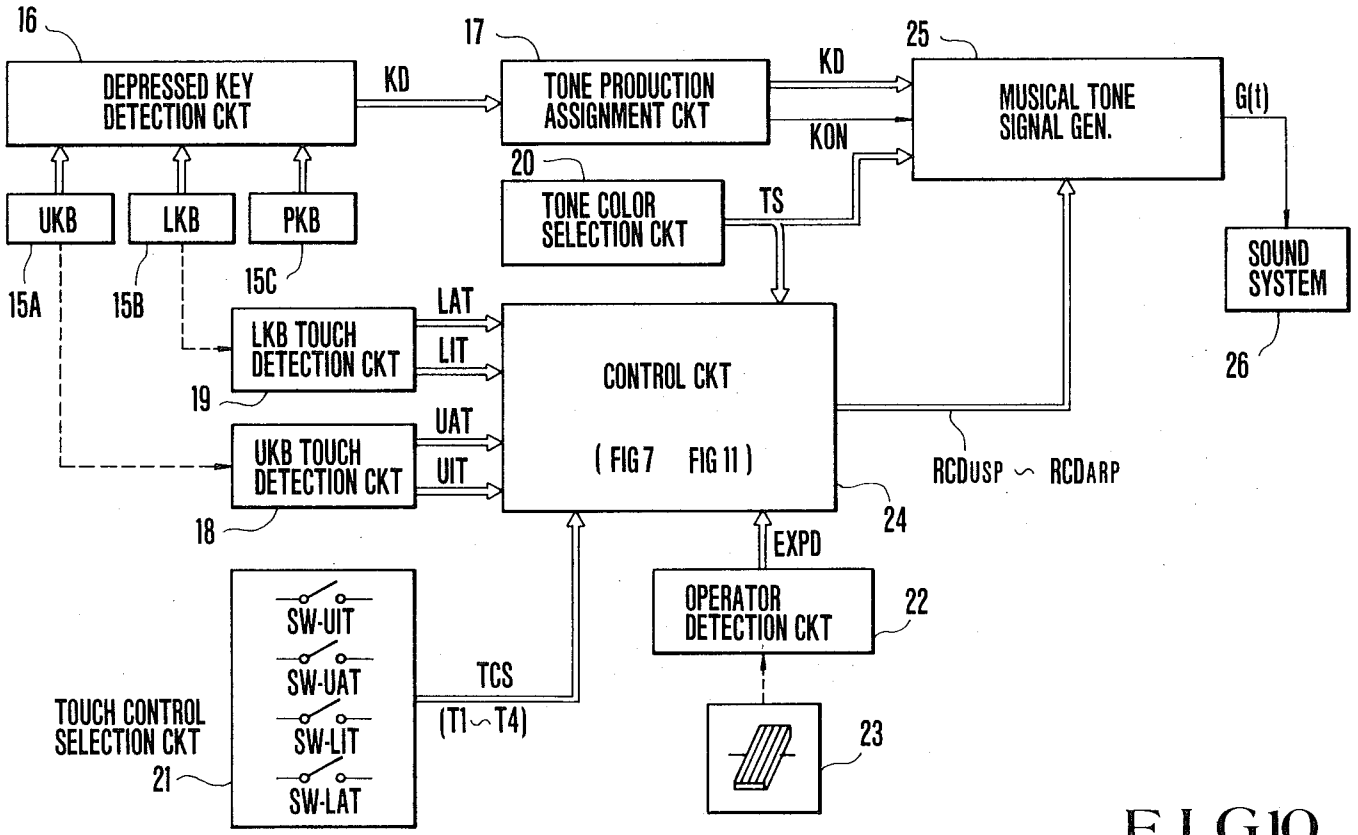
FIG. 10 is a block diagram showing one embodiment of the basic construction of this inventions.

FIG. 10 shows the detail of one embodiment of this invention.

In this embodiment, there are provided three keyboards, i.e., a upper keyboard UKB mainly performing a melody tone, a lower keyboard LKB performing an accompaniment tone, and a pedal keyboard PKB performing a bass tone, and the musical tones regarding the depressed keys of respective keyboards are formed, on the time division basis, by a plurality of time divisioned tone production channels.

Musical tones in relation with the depressed keys of the upper and lower keyboards in the musical tones formed on the time division basis, are simultaneously selected corresponding to the respective keyboards by a tone color selection circuit with reference to the color of a special tone type having a percussive envelope such as a piano, a harpsichord, and a guitar etc., and a color of the orchestra type having a sustained type envelope as a trombone, a clarinet and a trumpet etc.

For example, on the upper keyboard, when the tone colors of the special tone type and the orchestral tone type are selected, a single time division tone production channel is used on the time division basis so as to form musical tones having tone colors of the special tone type and the orchestral tone type.

In this embodiment an automatic arpeggio circuit is used for selecting, one after one, the musical tones regarding a plurality of depressed keys of the lower keyboard so as to also produce an arpeggio tone.

Thus, this embodiment is constructed to form the following 6 types of the musical tones.

(a) the upper keyboard special tone type
(b) the upper keyboard orchestra tone type,
(c) the lower keyboard special tone type,
(d) the lower keyboard orchestra tone type,
(e) the pedal keyboard and
(f) an automatic arpeggio tone.

In the following description, the circuit systems for producing the musical tones of the 6 types described above are termed musical tone generating systems.

The control of the musical tone effected by two control elements including the key touch state and the operation state of the expression pedal is performed for the musical tones of the four musical tone generating systems (a) through (d) described above. Where it is desired to emphasize the degree of control of the musical tone according to the key touch state, the musical tone control effected by only the control element of the key touch state is inhibited, and the musical tone control is effected by the control element of only the key touch state.

In this case, the musical tone control by the key touch state is effected by the musically optimum one of the initial touch state and the after touch state according to the selected tone color of the musical tone.

More particularly, in the case of a musical tone of such special tone type as piano, it is advantageous to control its musical tone element according to the key speed (or strength) at the time of starting key depression, whereas for a musical tone of the orchestra type as trombone, it is advantageous to control the musical tone element in accordance with the strength (or forces of the keys after being depressed.

The circuit shown in FIG. 10 is constructed such that the musical tone of the special tone type as a piano is controlled its musical tone element in accordance with the initial touch state at the time of starting key depression, while the musical tone of the orchestra tone type as trombone is controlled its musical tone element according to the after touch state after the key depression.

Although the present invention contemplates the control of various musical tone elements as the pitch, color and volume of a musical tone, for the sake of simplicity, in the following description only the control of the tone volume will be described.

Regarding the initial touch, this can be made by the circuit or disclosed in the aforementioned U.S. Pat. No. 3,784,718 or a circuit performing an equivalent automatic operation can be used, while the after touch can be made by the circuit shown in U.S. Pat. No. 3,965,789 or an equivalent circuit.

The embodiment shown in FIG. 10 comprises a depressed key detection circuit 16 which detects the depressed key states of a upper keyboard (LKB) 15A, a lower keyboard (LKB) 15B, and a pedal keyboard (PKB) 15C for producing a key code KD corresponding to a depressed key, and a tone production assignment circuit 17 which assigns the key code KD produced by the depressed key detection circuit 16 to either one of idle channels of a plurality of tone production channels at the musical tone signal generator not assigned with tone production for producing key codes assigned to respective channels in synchronism with the time devisioned channel time corresponding to respective channels.

The tone production assignment circuit 17 comprises an automatic arpeggio circuit sequentially selecting one of the key codes KD corresponding to the depressed key of the lower keyboard 15B over the key codes KD assigned to respective tone production channels for assigning the selected key code to a tone production channel exclusively used for the arpeggio tone and for outputting, in a corresponding channel time, the key code KD assigned to the specific tone production channel.

In addition to the key codes KD assigned to respective tone production channels, the tone production assignment circuit 17 produces a key-on signal KON showing that a key corresponding to a specific key code KD has been depressed in synchronism therewith.

The key code KD outputted from the tone production assignment circuit 17 is constituted by a note code NC made up of 4 bit signals N1 through N4 representing the note name of the depressed key, a block code BC made up of 3 bit signals $B_1$ through $B_3$ representing an octave tone range, and a keyboard code KBC made up of 2 bit signals $K_1$ and $K_2$ representing the keyboard name.

The tone production assignment circuit 17 performing such tone production assignment operation is constructed similar to that disclosed in U.S. Pat. No. 4,217,804 dated Aug. 18, 1980, for example.

There are provided upper keyboard (UKB) touch detection circuit 18 which detects the key touch state and the key touch state after depression of each key of the upper keyboard 15A, in terms of the depression speed and the depression strength, for producing a upper keyboard initial touch information UIT and a upper keyboard after touch information UAT; a lower keyboard (LKB) touch detection circuit 19 which detects the key touch state at the time of starting key depression and the key touch state after depression of each key of the lower keyboard 15B, in terms of depression speed and depression strength, for producing a lower keyboard initial touch information LIT and a lower keyboard after touch information LAT; a tone color selection circuit 20 including a plurality of tone color selection operators which selects tone colors of musical tone generating systems of the upper keyboard special tone type, the upper keyboard orchestra tone type . . . and the automatic arpeggio tone type described above for producing tone color selection informations TS representing the tone colors of respective musical tone generating systems selected by the tone color selection operations, and a touch control selection circuit 21 provided with touch control selection switches SW·UIT, SW·UAT, SW·LIT and SW·LAT for selecting or not the control of the musical tone elements effected by the initial touch information UIT and the after touch information UAT of the upper keyboard and the intial touch information LAT of the lower keyboard.

ON signals T1 through T4 of respective switches SW-UIT through SW-LAT of the touch control selection circuit 21 are outputted as touch control selection informations TCS for effecting the control of the volume of the musical tones effected by the touch informations UIT through LAT.

Furthermore, there are provided an operator detection circut 22 detecting the operation state (quantity operated) or the expression pedal 23 for producing an expression information EXPD corresponding to the operation state, and a control circuit 24 for varying the degree of control of the musical tone volume effected by the touch informations UIT through LAT and the expression information EXPD of respective musical tone signal gnerating systems of the upper keyboard special tone type, the upper keyboard orchestra tone type, and the automatic arpegio tone type. The control circuit produces range control informations $RCK_{USP}$, $RCD_{UOR}$, $RED_{LSP}$, $RCD_{LOR}$, $RCD_{PD}$ and $RCD_{ARP}$.

The range control informations $RCD_{USP}$ and $RCD_{LSD}$ respectively control the volumes of the musical tones of the musical tone producing systems of the upper keyboard special tone type and the lower keyboard special tone type, while the range control informations $RCD_{UOR}$ and $RCD_{LOR}$ respectively control the volumes of the musical tones of the musical tone signal generating system of the pedal keyboard and the musical tone generating tone signal system of the automatic arpeggio tone.

A musical tone signal generator 25 is provided with a plurality of time divisioned tone production channels which form musical tone signals having tone pitches corresponding to depressed key codes KD supplied from the tone production assignment circuit 17 in synchronism with the channel times corresponding to respective tone production channels, and tone colors corresponding to the contents of the respective musical tone signal generating systems. The musical signal generator 25 contains an envelope generator adapted to control the volume of the musical tones formed by respective tone production channels, and the level of the volume envelope information generated by the envelope generator is controlled by the range control informations $RCD_{USP}$ through $RCD_{ARP}$ for respective musical tone signal generating systems.

The volume envelope informations are generated for respective tone productions channels and the generation and termination thereof are controlled by the key-on signal KON of a corresponding tone productions channel.

Figure 11:
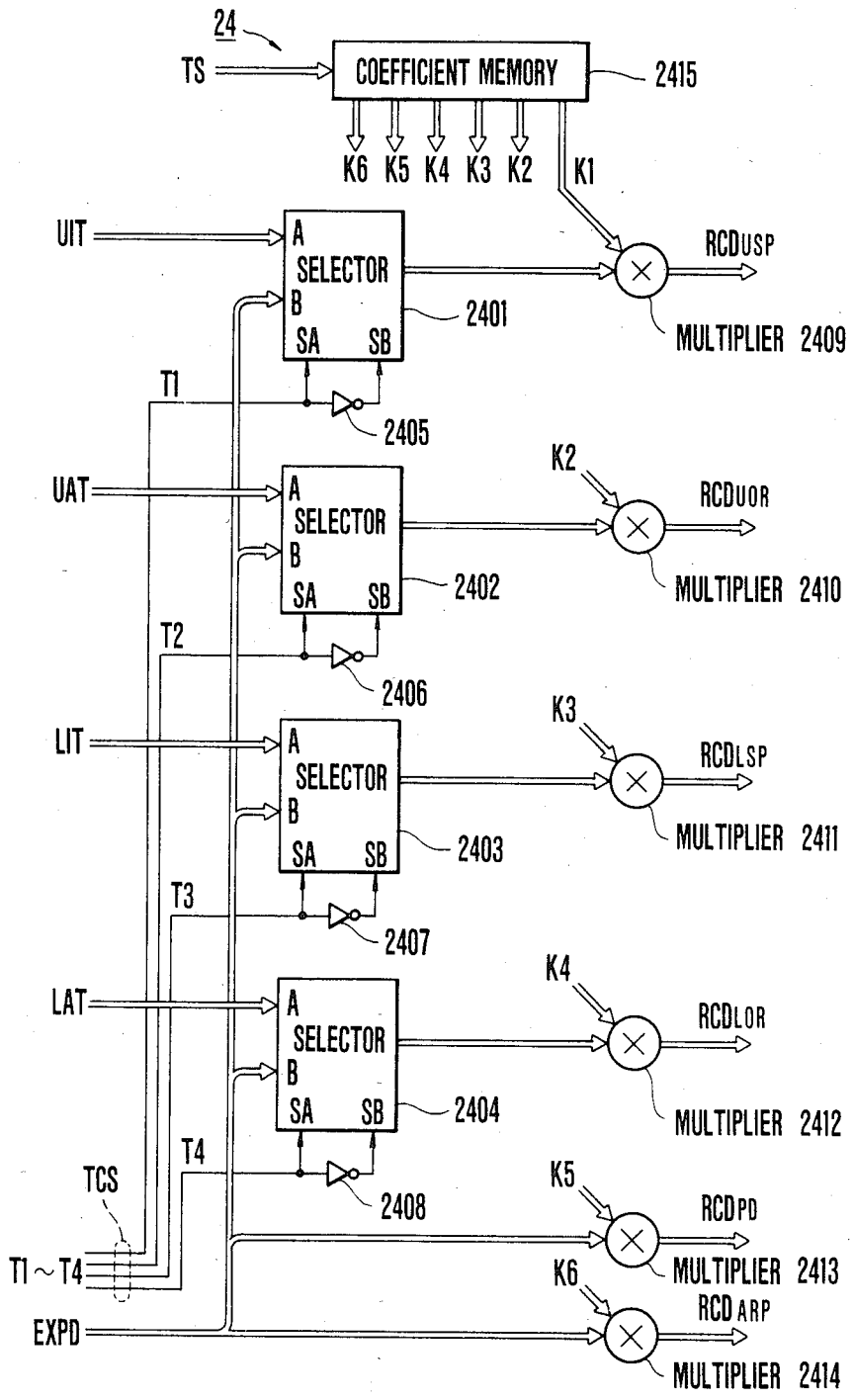
FIG. 11 is a block diagram showing one example of the control circuit shown in FIG. 10.

FIG. 11 is a block diagram showing one example of the detail of the control circuit 24 which comprises selectors 2401 through 2404, inverters 2405 through 2408, multipliers 2409 through 2414 and a coefficient memory device 2415.

Touch informations UIT, UAT, LIT and LAT outputted from touch detection circuits 18 and 19 are inputted to one input terminals A of respective selectors 2401 through 2404, while the expression information EXPD outputted from the operator detection circuit 22 is applied to the other input terminal B.

The control input terminals SA of the selectors 2401 through 2404 are supplied with ON signals T1 through T4 of switches SW·UIT through SW·LAT constituting a touch control selection information TCS and the other control input terminals SB are supplied with signals obtained by inverting the ON signals T1 through T4 with inventers 2405 through 2408. Selectors 2401 through 2404 select touch informations UIT through LAT when switches SW-UIT through SW-LAT are ON, whereas when these switches are OFF they select the expression information EXPD.

The informations selected and outputted from selectors 2401 through 2404 are supplied to multipliers 2409 through 2412 respectively. One inputs of the multipliers 2409 through 2412 are respectively supplied with the coefficient informations K1 through K4 generated by the coefficient memory device 2415. These coefficient informations K1 through K4 are used to apply a weight to the degree of control of the musical tone volume according to the content of the color selected in respective musical tone generating systems. In this example, a coefficient information K1 of the upper keyboard special tone signal generating system, a coefficient information K2 of the upper keyboard orchestra tone signal generating system, a coefficient information K3 of the lower keyboard special tone signal generating system, and a coefficient information K4 of the lower keyboard orchestra tone type musical tone signal generating system are generated based on the color selection information TS. Furthermore, coefficient informations K5 and K6 are generated which are used to add a weight to the degree of control of the musical tone volume of the pedal keyboard musical tone signal generating system and the automatic arpeggio musical tone signal generating system.

Accordingly, multipliers 2409 through 2412 multiply the expression information EXPD outputted from selectors 2401 through 2404 or touch informations UIT, UAT, LIT and LAT respectively with coefficient informations K1, K2, K3 and K4 for different musical tone generating systems and generated by the coefficient memory device 2415.

Consequently, the multiplier 2409 outputs a range control information $RCD_{USP}$ for controlling the volume of the upper keyboard special tone type musical tone signal generating system in accordance with the expression information EXPD or the initial touch information. In the same manner, the multiplier 2410 outputs a range control information $RCD_{UOR}$ for controlling the musical tone volume of the upper keyboard orchestra tone type musical tone generating system in accordance with the expression information EXPD or the after touch information UAT. Further, the multiplier 2411 outputs a range control information $RCD_{LSP}$ for controlling the musical tone volume of the lower keyboard special tone type musical tone signal generating system in accordance with the expression information EXPD or the initial touch information LIT, whereas the multiplier 2412 outputs a range control information $RCD_{LOR}$ for controlling the musical tone volume of the lower keyboard orchestra tone type musical tone signal generating system in accordance with the expression information EXPD or after touch informatiion UAT.

The coefficient informations K5 and K6 are respectively supplied to the multipliers 2413 and 2414 to be multiplied with the expression information EXPD so that the multiplier 2413 outputs a range control information $RCD_{PD}$ for controlling the musical tone volume of the pedal keyboard musical tone generating system in accordance with the expression information EXPD, and the multiplier 2414 outputs a range control information $RCD_{ARP}$ for controlling the musical tone volume of the automatic arpeggio tone musical tone signal generating system.

In the electronic musical instrument constructed as above described, when keys of upper keyboard 15A, lower keyboard 15B and pedal keyboard 15C are depressed, the depressed key detection circuit 16 detects the depressed keys of respective keyboards for supplying, on the time division basis, key codes KD corresponding to respective depressed keys to the tone production assignment circuit 17. Then the tone production assignment circuit 17 assigns these key informations to idle channels among a pluralily of tone production channels so as to produce the key codes KD in synchronism with the channel times corresponding to respective assigned channels together with key-on signals for controlling tone production. Furthermore, a key code KD among a plurality of key codes regarding depressed keys of the lower keyboard 15B is sequentially selected and assigned to a specific tone production channel for producing a tone production controlling key-on signal KON acting as a key information of the automatic arpeggio tone in synchronism with the channel time corresponding to the specific channel.

The upper keyboard touch detection circuit 18 and the lower keyboard touch detection circuit 19 and the lower keyboard touch detection circuit 19 detect the key depression speed and the depression strength after the key depression of the keys of the upper and lower keyboards 15A and 15B for supplying to the control circuit 24 initial touch informations UIT and LIT, and after touch informations UAT and LAT showing the key touch states of the upper and lower keyboards 15A and 15B.

At this time, the tone color selection circuit 20 selects the tone color of a piano with regard to the upper keyboard special tone type musical tone signal generating system, and the tone color of a clarinet with regard to the lower keyboard orchestra tone type musical tone signal generating system. On the other hand, in the touch control selection circuit 21, when switch SW-UIT is ON and switches SW-UAT through SW-LAT are ON, the control circuit 29 is supplied with a tone color selection information TS corresponding to the selected tone colors and the selection states of the switches, and a touch control selection information TCS.

As a consequence, the control circuit 24 outputs the product (UIT·K1) of the upper keyboard initial touch information UIT and the coefficient information KI of the upper keyboard special tone type musical tone generating system, the product being used as a range control information $RCD_{USP}$ regarding a piano tone of the upper keyboard special tone type musical tone signal generating system.

At the same time the products EXPD·K2, EXPD·K3, EXPD·K4, EXPD·K5 and EXPD·K6 of the expression information EXPD and the coefficient informations K2 through K6 are produced, these products acting as range control information, $RCD_{UOR}$, $RCD_{LSP}$, $RCD_{LOR}$, $RCD_{PD}$ and $RCD_{ARP}$ respectively regarding the upper keyboard orchestra tone type musical tone signal generating system, the lower keyboard special tone type musical tone signal generating system, the lower keyboard orchestra tone type musical tone signal generating system, and the automatic arpeggio tone type musical tone signal generating system. Then, based on the depressed key informations KD assigned to respective tone production channels, and a tone color selection informations TS of discrete musical tone generating systems formed by the tone color selection circuit 20, the musical tone signal generator 25 forms a musical tone signal having a tone pitch and color corresponding to these informations. Thereafter, the amplitude of the musical tone signal is controlled by a tone volume envelope information generated by the envelope generator.

At this time, the level of the tone volume envelope information is controlled by the range control informations $RCD_{USP}$ through $RCD_{ARP}$ supplied from the control circuit 24. Consequently, under the conditions described above, with regard to the content of the tone color selection effected by the tone color selection circuit 28, the volume of the piano tone of the upper keyboard special tone type musical tone signal generating system varies in accordance with the initial touch state, whereas the volumes of the tones of a clarinet of the lower keyboard orchestra tone type generating system, of a musical tone of the pedal keyboard musical tone signal generating system, and of the automatic arpeggio tone are varied in accordance with the extent of operation of the expression pedal 23.

On the assumption that the touch informations UIT through LAT and the expression information EXPD represent the amount of attenuation of the tone volume, and that as the key depression speed is increased, the touch informations UIT and LIT bocome smaller. When a relation is set in which the amount of attenuation of the tone volume envelope information becomes small, and the amount of the operation of the expression pedal 23 is increased, the expression information EXPD would become small, whereas when a relation is set such that the amount of attenuation of the volume envelope information decreases, and when only the switch SW-UIT of the touch control selection circuit 21 is turned ON, the key depression speed of the upper keyboard 15A would be increased. Furthermore, when performances are made on respective keyboards by setting the amount of operation of the expression pedal 23 to a small value, the musical tone (a piano tone) produced by the upper keyboard special tone type musical tone signal generating system would have a larger volume than the tones generated by the other musical tone signal generating systems.

In other words, the musical tone (piano tone) generated by the upper keyboard special tone type musical tone signal generating system is felt "floating."

Conversely, where the key depression speed of the upper keyboard is made small, and when the amount of operation of the key of the expression pedal 23 is made large, it is possible to make large the volume of the musical tones generated by the systems other than the upper keyboard special tone type musical tone signal generating system.

When a relation is set such that the after touch informations UAT and LAT become small when the key depression strength is increased, and that the amount of attenuation of the tone volume envelope information becomes small, when the switches SW-UIT and SW-LAT of the touch control selection circuit 21 are turned ON, while the other switches SW-UAT and SW-LIT are turned OFF, the volume of the musical tone (piano tone) generated by the upper keyboard special tone type musical tone signal generating system would be increased or emphasized when the key depression speed of the upper keyboard 15A is made faster, whereas when the key depression strength of the lower keyboard 15B is strengthened, the volume of the musical tone (clarinet tone) generated by the lower keyboard special tone type musical tone generating system would be increased.

Consequently, by suitably selecting the switches SW-UIT through SW-LAT of the touch control selection circuit 21, the musical tones can be produced from respective musical tone signal generating systems as ensemble effect tones with their volume varied in accordance with the key touch state or the amount of operation of the expression pedal 23.

Although in this embodiment, the combinations of the key touch informations are made different for respective musical tone signal generating systems, it is also possible to control a specific one of the musical tone signal generatig systems in accordance with the initial touch state and the after touch state.

Although the switches SW-UIT through SW-LAT of the touch control selection circuit 21 were described as of the manually operated type, they can be automatically operated in an interlocked relation with the tone color selection circuit 20. With these modifications, an ensemble effect tone most suitable for the selected color can be produced by only the tone color selection operation.

Figure 12:
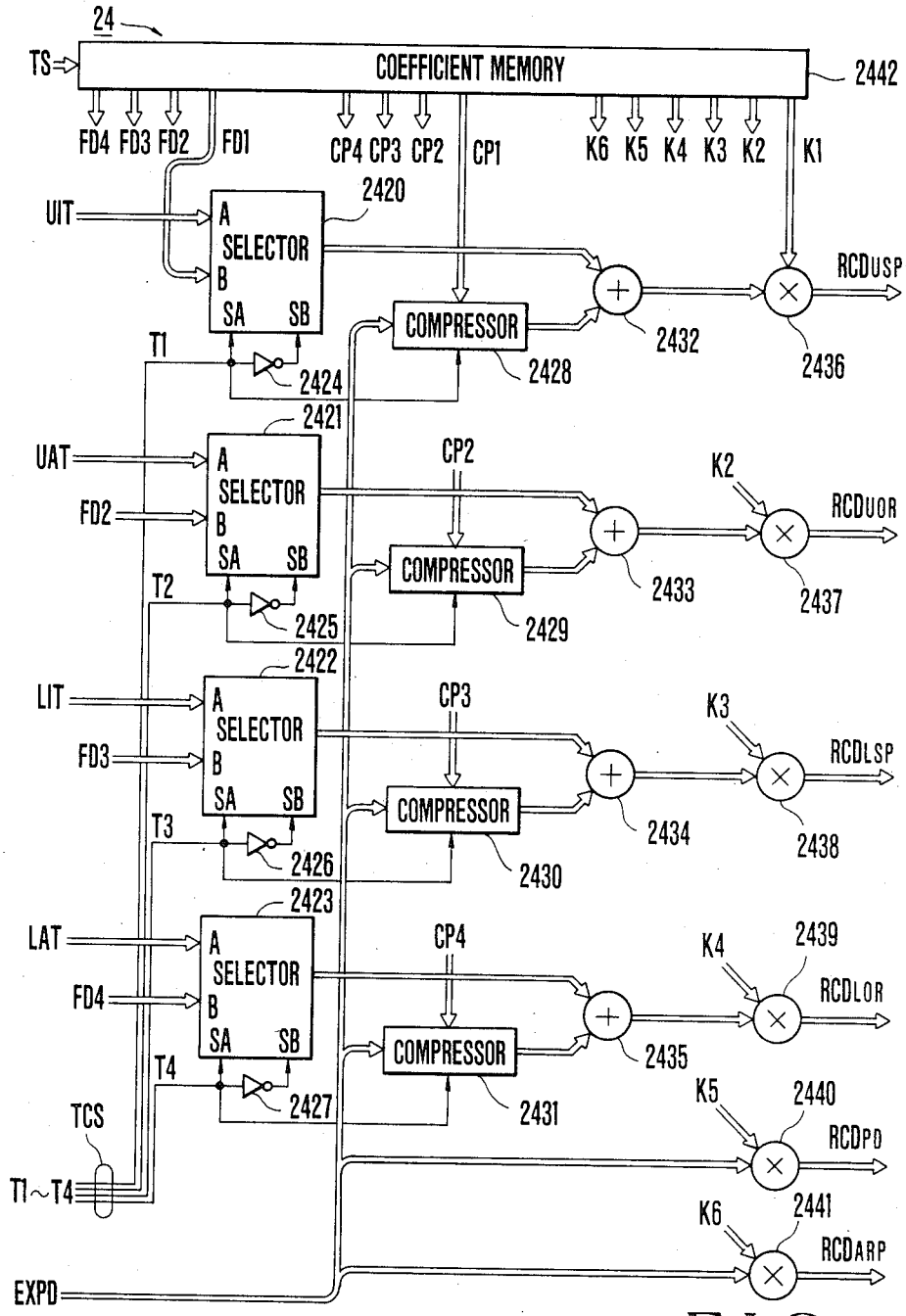
FIG. 12 is a block diagram showing another example of the control circuit shown in FIG. 10.

FIG. 12 is a block diagram showing the detail of another embodiment of the control circuit 24. This embodiment is constructed such that, with regard to a selected musical tone signal generating system, the control effected by the key touch suppresses the expression information EXPD, adds the suppressed information to the key touch information, a weight is added to the resulting sum, and the weighted information is outputted as range control informations ($RCD_{USP}$ through $RCD_{LOR}$) of a given musical tone signal generating system. In a musical tone signal generating system in which no control is selected by a key touch information, a predetermined fixed value is added to the expression information, a weight is added to the resulting sum, and the weighted sum is outputted as the range control informations ($RCD_{USP}$ through $RCD_{LOR}$) of the given musical tone generating system.

The pedal keyboard tone generating system and the automatic arpeggio tone musical tone generating system are constructed in the same manner as those shown in FIG. 11.

In FIG. 12, one inputs (A) of the selectors 2420 through 2423 are respectively supplied with the key touch informations UIT, UAT, LIT and LAT, while the other selector inputs (B) are respectively supplied with fixed informations FD1 through FD4 generated by a coefficient memory device 2442. The selection control inputs (SA) of the selectors 2420 through 2423 are respectively supplied with ON signals T1 through T4 of the switches SW-UIT through SW-LAT, while the other selection control inputs (SB) are respectively supplied with signals formed by inverting the ON signals T1 through T4 with inverters 2424 through 2427 respectively. Consequently, when the switches SW-UIT through SW-LAT are ON, the selectors select the touch informations UIT through LAT, whereas when the switches are OFF, the selectors select the fixed informations FD1 through FD4.

The fixed informations FD1 through FD4 generated by the coefficient memory device 2442 determine the maximum values (the minimum values of attenuations) of the volumes of the musical tones generated by respective musical tone signal generating systems. In this modification, the fixed informations FD1 and FD2 of the upper keyboard special tone type musical tone generating system and of the upper keyboard orchestra tone type musical tone generating system, and the fixed informations FD3 and FD4 of the lower keybbard special tone type musical tone generating system and of the lower keyboard orchestra tone type musical tone signal generating system are generated based on the tone color selection information TS and in accordance with the contents of the selected tone colors.

The expression information EXPD is commonly supplied to the compressors 2428 through 2431. Also the ON signals T1 through T4 of the switches SW-UIT through SW-LAT and the suppression informations CP1 through CP4 outputted from the coefficient memory device 2442 are supplied to the compressors.

Compressors 2428 through 2431 suppress the amount of attenuation shown by the expression information EXPD in accordance with the suppression informations CP1 through CP4 when the switches SW-UIT through SW-LAT are ON, and the outputs of the compressors are supplied to adders 2432 through 2435 respectively. In this case, the values of suppression information CP1 through CP4 are limitted to be less than unity for the purpose of suppressing the amount of attenuation of the tone volume effected by the expression information EXPD. In this modification, in the same manner as the fixed informations FD1 through FD4 described above, suppression informations CP1 and CP2 for the upper keyboard special tone type musical tone signal generating system and the upper keyboard orchestra tone musical tone signal generating system, and the suppression informations CP3 and CP4 for the lower keyboard special tone type musical tone signal generating system and the lower keyboard orchestra tone type musical tone signal generating system are generated by the coefficient memory device 2442 for respective musical tone signal generating systems.

Figure 13:
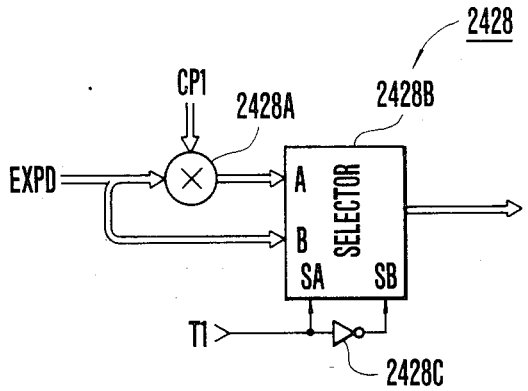
FIG. 13 is a connection diagram showing one example of a compressor shown in FIG. 12.

Taking compressor 2428 as the typical one of the compressors 2428 through 2431, it is constructed as shown in FIG. 13. More particularly, the expression information EXPD is inputted to a multiplier 2428A to be multiplexed with the suppression information CP1 to form an information EXPD·CP1 which is obtained by making small the information EXPD. The information EXPD·CP1 is applied to the input A of selector 2428B. To the other input of the selector 2428B is applied the impression information EXPD as it is. To the control input SA of the selector is applied the ON signal T1 of the switch SW-UIT, whereas a signal obtained by inverting the ON signal T1 with an inverter 2428C is applied to the control input SA.

Then when the switch SW-UIT is ON so that its ON signal T1 is "1", the selector 2428B selects the outpout information EXPD·CP1 of multiplier 2428A.

In other words, the selector 2428B outputs an information EXPD·CP1 formed by suppressing the information with the suppression information CP1. Conversely, when the switch SW-UIT is turned OFF so that the ON signal T1 becomes "0", the selector 2428B selects the expression information EXPD as it is.

Other compressors 2429 through 2431 are constructed similarly.

The outputs of the compressors 2428 through 2431 are applied to adders 2432 through 2435 respectively to be added to the outputs of the selectors 2420 through 2423.

Accordingly, when the switch SW-UIT is ON, the adder 2432 adds an information obtained by suppressing the expression information EXPD with the suppression information to the upper keyboard initial touch information UIT, thus forming a sum (UIT+EXPD·CP1).

Conversely, when the switch SW-UIT is OFF, a sum (FD1+EXPD) of the fixed information FD1 and the expression information EXPD is formed.

In the same manner, when the switch SW-UAT is ON, the adder 2433 forms a sum (UAT+EXPD·CP2) of an information EXPD·CP2 obtained by suppressing the expression information EXPD with a suppression information CP2, and the upper keyboard after touch information UAT, whereas when the switch SW-UAT is OFF, the sum (FD2+EXPD) of the fixed information FD2 and the expression information EXPD is formed.

When the switch SW-LIT is ON, adder 2434 forms a sum (LIT+EXPD·CP3) of an information obtained by suppressing the expression information EXPD with the suppression information CP3 and the lower keyboard initial touch information LIT, whereas when the switch SW-LIT is OFF, the sum (FD3+EXPD) of the fixed information FD3 and the expression information EXPD is formed. When the switch SW-LAT is OFF, the adder 2435 forms the sum (LAT+EXPD·CP4) of an information formed by suppressing the expression information EXPD with an suppression information CP4 and the lower keyboard after touch information LAT, whereas when the switch SW-LAT is OFF the sum (FD4+EXPD) of the fixed information FD4 and the expression information EXPD is formed.

The outputs of the adders 2432 through 2435 are respectively supplied to multipliers 2436 through 2439 where the outputs of the adders are multiplied with coefficient informations K1 through K4 for respective musical tone signal generating systems whereby weights are added. The purpose of the coefficient informations K1 through K4 is to adjust the degree of control of the musical tone elements for the basic tone color of the spcial tone type and the orchestra tone type selected for respective musical tone signal generating systems in accordance with the selected color in the same manner as in the embodiment shown in FIG. 11.

The range control informations $RCD_{PD}$ and $RCD_{ARP}$ regarding the musical tone signal generating systems of the pedal keyboard and the automatic arpeggio tone are formed by multiplying the expression information EXPD with coefficient informations K5 and K6 corresponding to these musical tone generating systems in multipliers 2440 and 2441 so as to add weights.

As above described, the multiplier 2436 outputs a range control information $RCD_{USP}$ in which the musical tone volume of the upper keyboard special tone musical tone generating system is controlled by an information [K1·(UIT+EXPD·CP1)] or [K1·(FD1+EXPD)] depending upon the selection state of the switch SW-UIT.

On the other hand, the multiplier 2437 produces a range control information $RCD_{UOR}$ in which the musical tone volume of the upper keyboard orchestra tone type musical tone signal generating system is controlled by an information [K2·(UAT+EXPD·CP2)] or [K2·(FD2+EXPD)] depending upon the state of selection of the switch SW-UAT.

In the same manner, the multiplier 2438 outputs a range control information $RCD_{LSP}$ in which the musical tone volume of the lower keyboard special tone type musical tone signal generating system is controlled by an information [K3·(LIT+EXPD·CP3)] or [K3·(FD3+EXPD)] depending upon the state of selection of the switch SW-LIT.

The multiplier 2439 outputs a range control information $RCD_{LOR}$ in which the musical tone volume of the lower keyboard orchestra tone type musical signal tone generating system is controlled by an information [K4·(LAT+EXPD·CP4)] or [K4·(FD4+EXPD)].

Figure 14A:
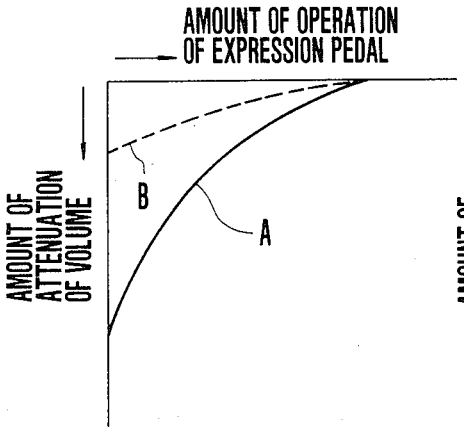
FIGS. 14*a* through 14*d* are graphs showing tone volume control characteristics of the embodiment shown in FIG. 12.

Accordingly, when it is assumed that all of the key touch informations UIT through LAT, the expression information EXPD, the fixed informations FD1 through FD4, the suppression informations CP1 through CP4 represent the amount of attenuation of the musical tone volume, that the degree of operation of the expression pedal is large, and that the circuit elements are set such that the information EXPD becomes small, and the volume increases as shown by a solid line A shown in FIG. 14*a*, as switches SW-UIT through SW-LAT are closed, the characteristics of the informations EXPD·CP1, EXPD·CP2, EXPD·CP3 and EXPD·CP4 obtainable from the compressors 2428 through 2431 would be suppressed such that the amount of attenuation of the musical tone volume decreases as shown by a dotted line B in FIG. 14*a* because these informations are multiplied with suppresion informations CP1 through CP4 of less than unity.

Figure 14B:
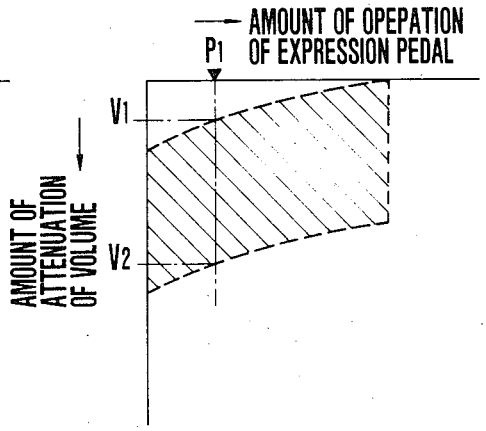

When the informations EXPD·CP1 through EXPD·CP4 having such characteristics are added to the key touch informations UIT through LAT respectively with adders 2432 through 2435, the resulting sum informations (UIT+EXPD·CP1), (UAT+EXPD·CP2), (LIT+EXPD·CP3) and (LAT+EXPD·CP4) would have characteristics as shown by inclined portions in FIG. 14*b* in which the amount of attenuation of the musical tone volume increases when the keys are depressed slowly or weakly by setting the amount of attenuation expressed by the outputs of compressors 2428 through 2431 to a minimum value.

Accordingly, as a key is depressed most fastly or strongly after fixing the expression pedal 23 at an amount of operation corresponding to a point P1 shown in FIG. 14*b*, the musical tone would be produced with an amount of attenuation shown by $V_1$. Conversely, when the key is depressed most slowly or with weakest force the musical tone would be produced with an attenuation shown by $V_2$.

Figure 14C:
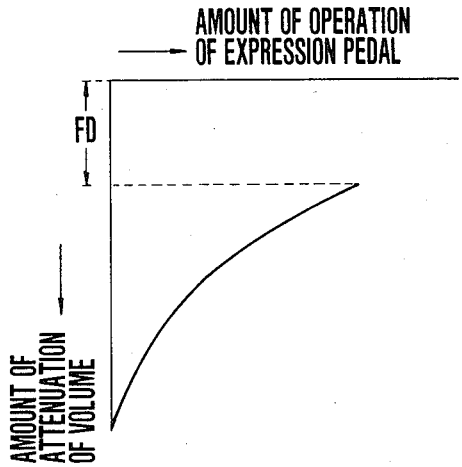

When the switches SW-UIT through SW-LAT are opened, since fixed informations FD1 through FD4 are respectively added to the expression information EXPD the sum informations (EXPD+FD1), (EXPD+FD2), (EXPD+FD3) and (EXPD+FD4) obtainable from adders 2432 through 2435 would have characteristics as shown in FIG. 14*c* in which the amount of attenuation shown by the expression information EXPD will be increased by te fixed information FD1 through FD4. In other words, the minimum value of the attenuation shown by the expression impression EXPD would be limited by the fixed informations FD1 through FD4. Consequently, even though the expression pedal 23 is operated to its maximum extent, the maximum volume of the musical tone would correspond to the fixed informations FD1 through FD4.

Figure 14D:
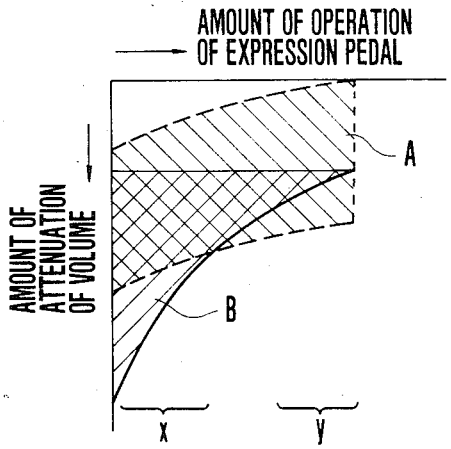

FIG. 14*d* shows a comparison of the characteristics of the range control informations RCD of a musical tone signal generating system in which the volume is controlled by the key touch state and of a musical tone signal generating system in which the volume is not controlled. As shown in FIG. 14*d*, the former characteristic is shown by an inclined line A, whereas the latter is shown by an inclined line B. For this reason, in a range x in which the amount of operation of the expression pedal 23 is small it is possible to emphasize the musical tone volume of a musical tone signal generating system in which a control effected by the key touch information in selected, whereas in a range and in which the amount of operation of the expression pedal is large, the musical tone volume of a musical tone signal generating system in which the control effected by the key touch information is not selected can be made large or emphasized.

Thus, it is possible to produce ensemble effect tones having various musical expression effects according to correlations between the key touch state and the amount of operation of the expression pedal 23.

Figure 15:
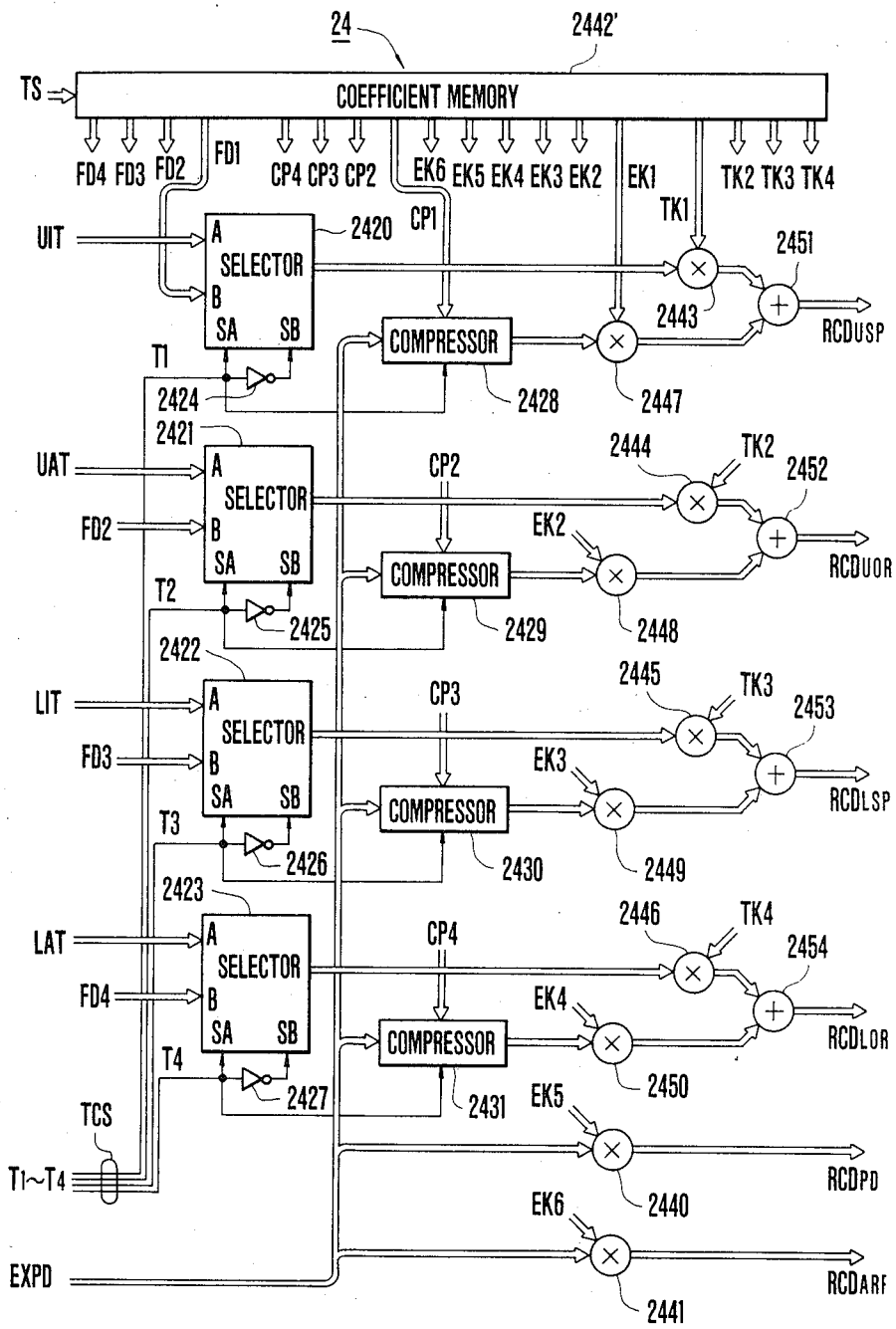
FIG. 15 is a block diagram showing another embodiment of the control circuit shown in FIG. 10.

FIG. 15 shows another example of the control circuit 24 which is basically the same as that shown in FIG. 12 in that, in a musical tone signal generating system in which the control effected by the key touch information is selected, the expression information EXPD is suppressed and then added to the key touch information and the sums are outputted as the range control informations $RCD_{USP}$ through $RCD_{LOR}$ for respective musical tone signal generating systems. In this example, however, the key touch information and the suppressed expression information EXPD are added together after being added with weights with independent coefficient informations, and the sums are utilized as the range control informations $RCD_{USP}$ through $RCD_{LOR}$.

In a musical tone generating system in which the control effected by the key touch information is selected, a fixed value is added to the expression information, and the sums are outputted as the range control informations $RCD_{USP}$ through $RCD_{LOR}$ just in the same manner as in FIG. 12. In this case, however, when adding together the expression information EXPD and the fixed value, the addition operation is performed after adding weights with independent coefficient informations.

Consequently, in this example, the selectors selecting the key touch information UIT through LAT or fixed informations FD1 through FD4 depending upon the state of selection of switches SW-UIT through SW-LAT, and the compressors selecting the expression information EXPD or informations EXPD·CP1 thorugh EXPD·CP4 obtained by suppressing the information with suppression informations CP1 through CP4 may have the same construction as those shown in FIG. 12 so that these elements are designated by the same reference characters. The pedal keyboard and the elements of the musical tone signal generating system for producing an automatic arpeggio tone have the same construction as those shown is FIG. 12 except that the coefficients K5 and K6 are changed to EK5 and EK6 respectively.

Consequently, only the difference between the examples shown in FIGS. 12 and 15 will be described. Thus, the outputs (UIT through LAT or FD1 through FD4) of the selectors 2420 through 2423 are supplied to multipliers 2443 through 2446 respectively to be multiplied with coefficient informations TK1 through TK4 of a musical tone signal generating system, which are generated by a coefficient memory device 2442', whereby applied with weights.

The outputs of compressors 2428 through 2431 (EXPD or EXPD·CP1 through EXPD·CP4) are respectively supplied to multipliers 2447 through 2450 to be multiplied with coefficient informations EK1 through EK4 of a musical tone signal generating system, which are generated by the coefficient memory device 2442', thereby added with weights.

The outputs of the multipliers 2443 through 2446 and 2447 through 2450 are respectively applied to adders 2451 through 2454 and the resulting sums are outputted as the range control signals $RCD_{USP}$ through $RCD_{LOR}$ for respective musical tone signal generating systems.

Where the control circuit 24 shown in FIG. 15 is used by making defferent the coefficient informations TK1 through TK4 for respective musical tone signal generating systems, even between two musical tone signal generating systems which select the control effected by the key touch information, the degrees of controls effected by the key touch information would become different. More particularly, where the volume of the upper keyboard special tone type musical tone signal generating system is controlled by the initial touch information UIT, the amount of the musical tone volume controlled by this information UIT is determined by the coefficient information TK1. In the same manner, where the volume of the lower keyboard special tone type musical tone signal generating system is controlled by the initial touch information LIT, the amount of controlling the musical tone volume effected by this information LIT is determined by the coefficient information TK3.

Figure 16A:
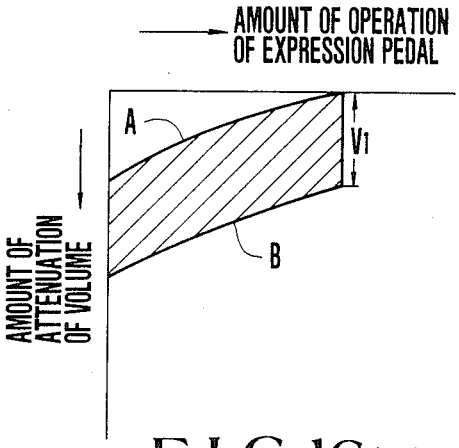
FIGS. 16*a* through 16*d* are graphs showing the tone volume control characteristic of the embodiment shown in FIG. 15.
Figure 16B:
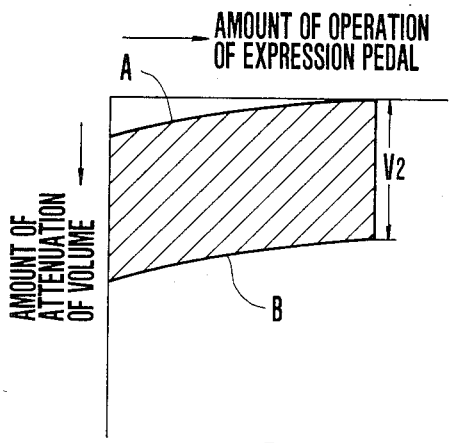

For this reason, where the coefficient information TK1 is made small, and the coefficient information TK3 is made large, in the former case the musical tone volume is controlled over an amount $V_1$ shown in FIG. 16*a*, while in the latter case the musical tone volume is controlled over an amount $V_2$ shown in FIG. 16*b*. More particularly, this means that the control sensitivities of the key touch informations UIT and LIT are controlled by the coefficient informations TK1 and TK2. Consequently, when the keys of the upper and lower keyboards 15A and 15B are operated by the same depression speed, the performance tone of the lower keyboard 15B would become more sensitive to the key touch state.

In this case, if the expression information EXPD were the same, the maximum value of the tone volume is determined by the combinations of suppression informations CP1 and CP3 and the coefficient informations EK1 and EK3. More particularly, the attenuation characteristic curve shown by A in FIG. 16*a* is determined by the informations EK1 and CP3, while the attenuation characteristic curve shown by A in FIG. 16*b* is determined by the informations EK3 and CP3. Consequently by making larger the information EK1 than the information EK3, that is when EK1·TK1>EK3·TK3, the volume of the performance tone of the lower keyboard 15B would become larger when the depression speeds of the keys of the upper and the lower keyboards 15A and 15B are the same.

Thus, even when the control is effected only by the key touch information, ensemble effect tones having various musical expression can be formed according to the set content of the informations TK1, TK3, EK1 and EK3.

Even in a musical tone signal generating system in which the control effected by the key touch information is not selected, the degree of control effected by the informations CP1 through CP4, EK1 through EK4 and TK1 through TK4 becomes different. For example, where volume of the upper keyboard special tone type musical tone signal generating system is controlled by the expression information EXPD, the amount of control is determined by the suppression information CP1 and the coefficient information EK1. In the same manner, where the volume of the lower keyboard special tone type musical tone signal generating system is controlled by the expression information EXPD, the amount of the control is determined by the suppression information CP3 and the coefficient information EK3.

Accordingly, where the product (CP1·EK1) of informations CP1 and EK1 is made larger than the product (CP3·EK3) of informations CP3 and EK3, in the former case the musical tone volume is controlled with a variable amount $V_3$ shown in FIG. 12*c*, while in the latter case, the volume is controlled with a variable amount $V_4$ shown in FIG. 12*d*. This means that the control sensitivity of the expression information EXPD is controlled by the values of informations CP1, CP3, EK1 and EK3.

Thus, in a case where CP1·EK1 >CP3·EK3, the performance tone of the upper keyboard 15A is produced as a tone more sensitive to the variation in the amount of operation of the expression pedal.

Figure 16C:
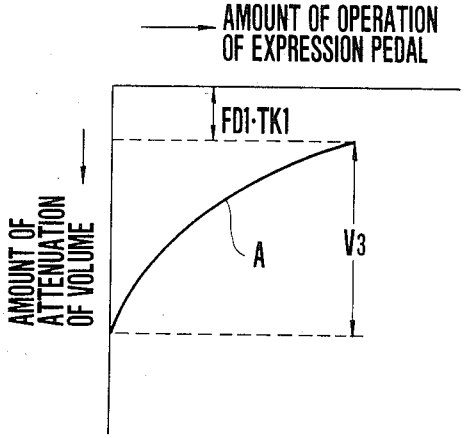

In this case, the maximum value of the tone volume is determined by the combination of the fixed informations FD1 and FD3 and the coefficient informations TK1 and TK3. More particularly, a point on the attenuation characteristic curve shown by A in FIG. 16*c* at which the attenuation becomes minimum is determined by the product (FD1·TK1) of the informations FD1 and TK1, while a point or the attenuation characteristic curve shown by A in FIG. 16*d* at which the attenuation becomes a minimum is determined by the product (FGD3·TK3) of informations FD3 and TK3.

Consequently, even when equation EXPD·CP-1·EK1=EXPD·CP3·EK3 holds, the volume of the performance tone of the upper keyboard 15A becomes large so long as a relation FD1·TK1<FD3·TK3 holds.

As a result, it is possible to produce ensemble performance tones wherein musical expressions vary variously according to the contents of the settings of the informations CP1, CP3, TK1, TK3, FD1, FD3, EK1 and EK3 only by the operation of the expression pedal 23.

Figure 16D:
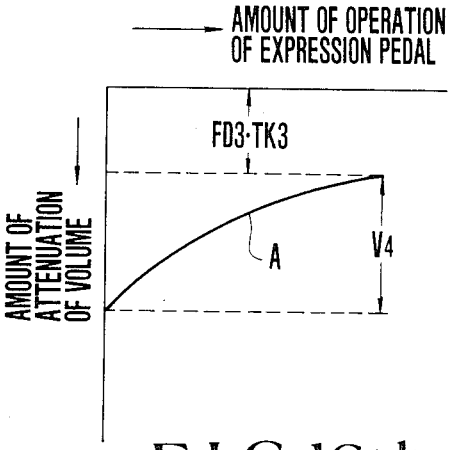

In a musical tone signal generating system in which the control effected by the key touch information is selected, the control is made with a characteristic as shown in FIG. 12*a*, whereas in a musical tone signal generating system in which the control effected by the expression information EXPD is selected, the values of various informations are set such that the control is made according to a characteristic as shown in FIG. 16*d*. In the former musical tone signal generating system, the musical tone can be made more sensitive to the key touch state.

Figure 17:
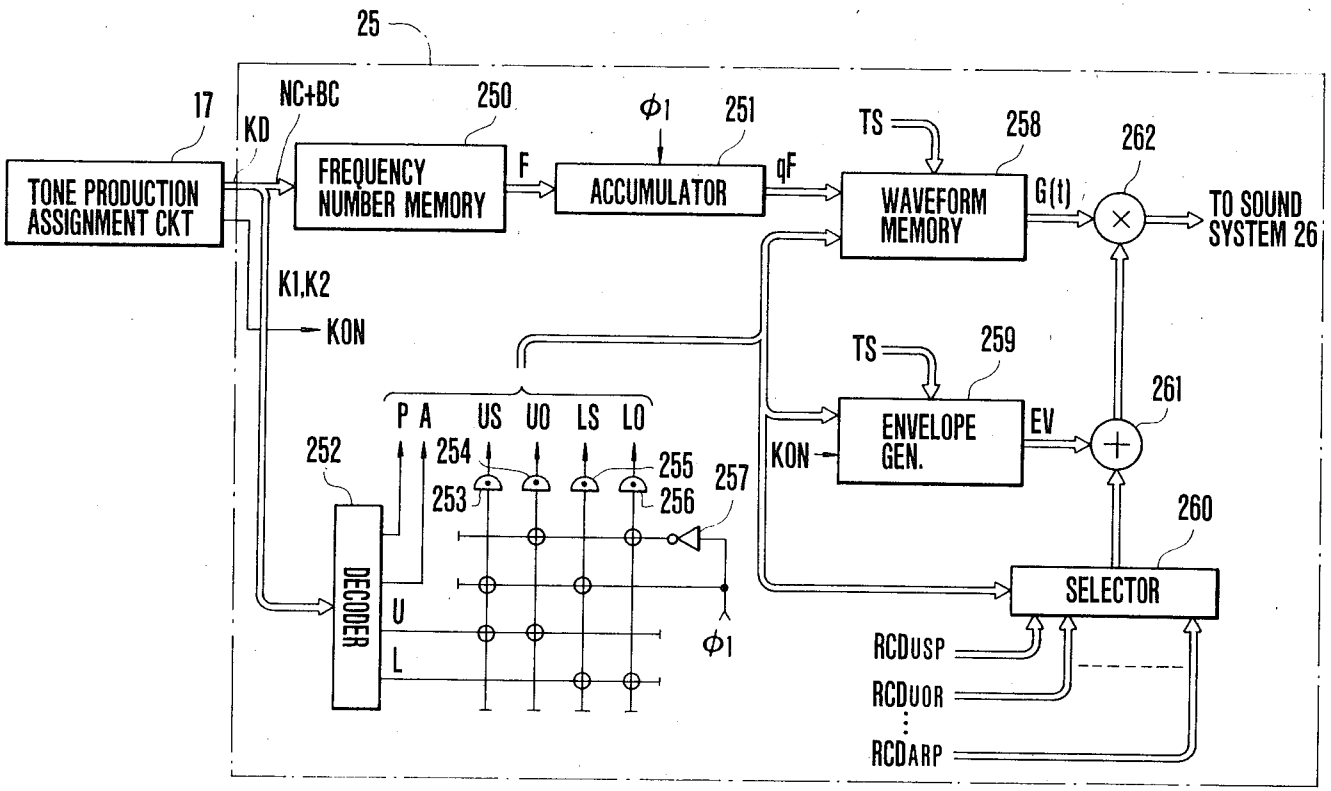
FIG. 17 is a block diagram showing one embodiment of the musical tone signal generator shown in FIG. 10.

FIG. 17 shown one example of the musical signal generator 25 in which the note code NC and the block code BC contained in the key code KD supplied from the tone production assingment circuit 17 are applied, as address signals, for a frequency number memory device 250.

Each address of the frequency number memory device 250 stores a frequency number (numeral information) F corresponding to the note code NC and the block code BC, that is the tone pitch of each key. Thus, by applying a note code NC and block code BC as an address signal, a frequency number F corresponding to these codes NC and BC can be read out.

This frequency number F is supplied to an accumulator to be accumulated according to a clock pulse $\phi 1$ for respective tone production channels, on the time division basis. Accordingly, an accumulated value qF(q=1,2,3. . . ) having a repetition period corresponding to the frequency number F is formed for each channel. Thus, the accumulator 251 outputs, on the time division basis, the accumulated value qF having a repetition period corresponding to the tone pitch of a depressed key assigned to each channel.

The keyboard codes K1 and K2, the constituting elements of the key code KD, are supplied to a decoder 252 to be decoded to determine that a given key code KD corresponds to which one of the keyboards. Consequently, depending upon the contents of the keyboard code K1 and K2, keyboard signals U,L,P and A are outputted showing that the key code KD relates to which one of the upper keyboard 15A, the lower keyboard 15B, the pedal keyboard 15C and the automatic arpeggio tone.

The signal U among these keyboard signals U,L,P and A, is inputted to both AND gate circuits 253 and 254, and the signal L is applied to both AND gate circuits 255 and 256.

AND gate circuits 253 through 256 are provided for the purpose of forming a timing signal for forming, on the time division basis, musical tones of the musical tone signal generating systems of the special tone type and of the orchestra tone type in one tone prodution channel. To one inputs of AND gate circuits 253 and 255 is applied a clock pulse $\phi 1$ while to the inputs of AND gate circuits 254 and 256 is applied a signal formed by inverting the clock pulse $\phi 1$ with an inverter 257.

Figure 18:
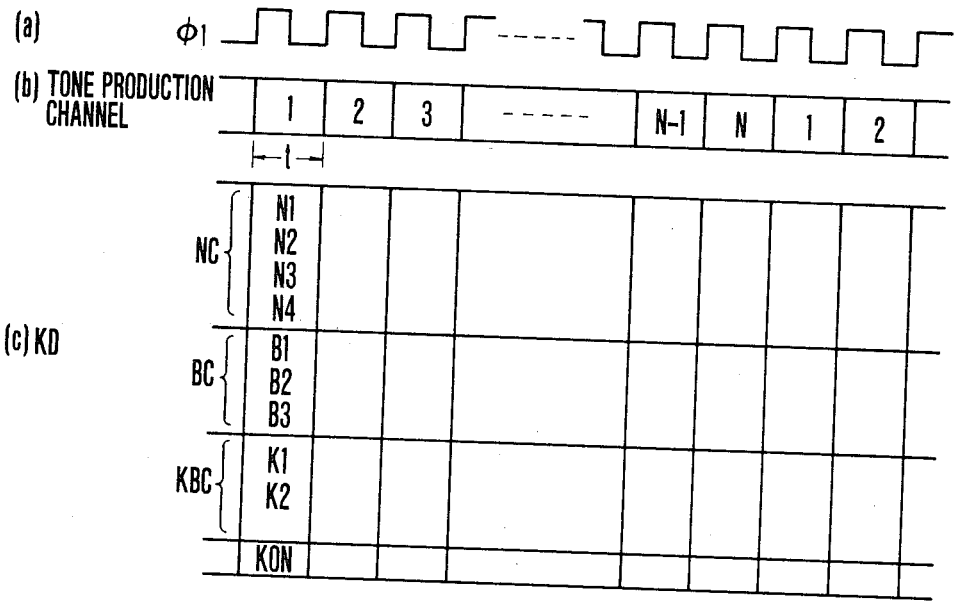
FIG. 18 is a timing chart showing the time relation between the tone production channel and the key information shown in FIG. 17.

As shown in FIGS. 18*a* and 18*b*, the clock pulse $\phi 1$ determines the channel time of the time divisioned tone production channels and becomes "1" and "0" in the fore half and latter half portions of each channel time.

Consequently, where the key code KD supplied from the tone production assignment circuit 17 concerns the upper keyboard 15A or lower keyboard 15B while the clock pulse $\phi 1$ is "1", AND gate circuit 253 or 255 outputs a signal US or LS of "1", whereas while the clock pulse $\phi 1$ is "0", AND gate circuit 254 or 256 outputs a signal UO or LO of "1".

Thus, where the key code KD concerns the upper keyboard 15A, in the fore half channel time of a tone production channel assigned with the key code KD, AND gate circuit 253 produces a timing signal US showing that the special tone type musical tone is to be formed, while in the latter half channel time, AND gate cirucit 254 produces a timing signal showing that an orchestra tone type musical tone is to be formed.

Where the key code KD concerns the lower keyboard 15B, in the fore half channel time of a tone production channel assigned with the key code KD, AND gate circuit 255 produces a timing signal LS showing that a special tone type musical tone is to be formed, while in the latter half channel time, AND gate circuit 256 produces a timing signal LO showing that an orchestra tone type musical tone is to be formed.

Since the musical tone signal forming system for the pedal keyboard 15*c* and the automatic arpeggio tone is only one, the output signals P and A of the decoder 252 are used as they are as a timing signal showing that the musical tone of that musical tone signal generating system is to form a musical tone.

The timing signals US through LO, P and A outputted from the AND gate circuits 253 through 256 and decoder 252 are supplied to a waveform memory device 258, an envelope generator 259 and a selector 260.

The waveform memory device 258 is prestoring the amplitude values of the musical tone waveforms respectively corresponding to various tone colors selectable by the color selection circuit 20, in the form of sample values G(t) at a predetermined spacing. Consequently, when timing signals US through A and the tone color selection signal TS are supplied to the waveform memory device 255 as upper order address signals and where the accumulated value qF outputted from the accumulator 251 is supplied as the lower order address signal, sample values G(t) having musical tone waveforms corresponding to signals US through A and the color selection information TS are sequentially read out in accordance with the variation of the accumulated value qF. In other words, musical tone waveform amplitute values G(t) corresponding to the timing signals US through A and the tone color selection information TS are sequentially generated at a speed corresponding to the repetition period of the accumulated value qF.

The envelope generator 259 contains an arithmetic operation circuit, not shown, that forms a volume envelope information EV corresponding to various tone colors selectable by the tone color selection circuit 20. The information of the envelope information EV by the arithmetic operation circuit is controlled, on the time division basis, for respective tone production channels by a key-on signal KON supplied from the tone production assignment circuit 17.

When tone color selection information TS, timing signal US through A and key-on signal KON are supplied to the envelope generator 259, it produces, on the time division basis, an envelope information corresponding to the signal US through A and information TS.

The range control informations $RCD_{USP}$ through $RCD_{ARP}$ outputted form the control circuit 24 are inputted to one input terminal of the selector 260 so as to select one of the range control informations respectively corresponding to the timing signals US through A. The selected range control information is supplied to an adder 261 to be added with the volume envelope information EV so as to modify the same.

The output information $k \cdot EV(k = RCD_{USP}, RCD_{UOR}, RCD_{LSP}, RCD_{LOR}, RCD_{PD}, RCD_{ARP})$ is applied to a multiplier 262 to be multiplied with a musical tone waveform sample value G(t) outputted from the waveform memory device 258, thus controlling the amplitude value of the musical tone waveform sample value G(t) and then supply it to sound system 26.

Various parts of the musical tone signal generator described above operate, on the time division bais, in synchronism with the key code KC and the key-on signal KON outputted, on the time division basis, from the tone production assignment circuit 17. The number of time slots for the time divisioned operation is N which corresponds to the number of tones simultaneously produced. The N time slots are herein termed tone production channels.

As shown in FIG. 18*b*, the N time slots have a time amount corresponding to the period t of the clock pulse $\phi$1 and the key codes KD assigned to respective channels are outputted together with the key-on signal KON, on the time division basis, in synchronism with respective time slots as shown in FIG. 14*c*. Thus, the musical tone signal generator 25 forms, on the time division basis, the musical tone waveform sample values G(t) corresponding to the key codes KD assigned to respective tone production channels.

Thus, with this musical tone signal generator 25, the volume envelope informations EV outputted form the envelope generator 259 in respective channel times are modified by the range control informations outputted from the selector 260 for respective musical tone signal generating systems.

Thus, the volume of the musical tone is controlled by one or both of the key touch state and the operation state of the expression bedal 23 in accordance with the selection of the switches SW-UIT through SW-LAT of the touch control selection circuit 21.

Although in this musical tone signal generator 25, the volume envelope information is controlled by the range control informations $RCD_{USP}$ through $RCD_{ARP}$, the pitch of the musical tone can also be controlled by a correction control of the frequency number F. Where a musical tone signal is formed by a frequency modulation system, the color of the musical tone can be controlled by a correction control of the modulation index. In the same manner, in various other musical tone forming systems it is possible to similarly control the pitch, color and volume of a musical tone, with the result that an ensemble effect rich in musical expression can be realized with a simple performance operation.

Although in the control circuit 24 shown in FIG. 11, the key touch informations UIT through LAT and the expression information EXPD are parallely selected by four selectros 2401 through 2404 for respective musical tone signal generating systems it is possible to select them, on the time division basis, with a single selector by using timing signals outputted from AND gate circuits 253 through 256 shown in FIG. 17.

Figure 19:
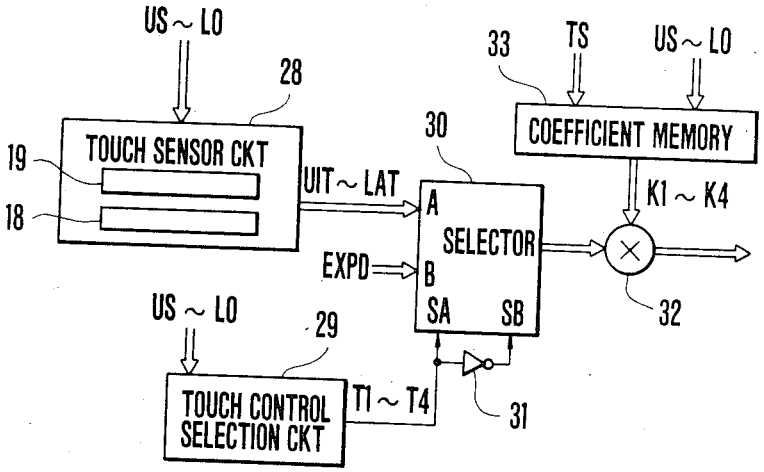
FIG. 19 is a block diagram showing another example of the control circuit shown in FIG. 10.

As shown in FIG. 19, in a touch sensor circuit 28, one of the key touch informations UIT,UAT,LIT and LAT outputted form the upper keyboard touch detection circuit 18 and the lower keyboard touch detection circuit 19 is selected, on the time division basis, with timing signals US through LO to apply the selected information to one input A of the selector 30 with the other input terminal B supplied with the expression information EXPD. In the same manner as in the embodiment shown in FIG. 6, the selection state signals T1 through T4 of respective switches SW-UIT through SW-LAT of the touch control selection circuit 29 is selected, on the time division basis, with the timing signals US through LO for supplying the selected signal to the control input SA of the selector 30. Further, a signal formed by inverting the selected signal with an inverter 31 is supplied to the other input terminal SB of the selector 30.

Then, for example, at a time at which the timing signal is generted, the touch sensor circuit 28 selects the upper keyboard initial touch information UIT. As a consequence, when the switch SW-UIT is closed, the selector 30 selects the upper keyboard initial touch information UIT. On the other hand, when the switch SW-UIT is OFF, the selector 30 selects the expression information EXPD.

In the same manner, at times at which timing signals UA,LS and LO are generated touch informations UAT,LIT and LAT or the expression information EXPD is selected depending upon the ON/OFF states of the switches SW-UAT, SW-LIT and SW-LAT.

The circuit is contstructed such that also the coefficient informations K1 through K4 for adding weights to the output informations of the selector 30 are outputted, on the time division basis, from the coefficient memory divice 33 at the times of generating the timing signals US through LO, and that weights are added to the informations selected, on the time division basis, by the selector 30 with the multiplier 32. With this construction, the multiplier 32 produces range control informations $RCD_{USP}$ through $RCD_{UOR}$ equivalent to the informations selected by the selector 260.

Figure 20:
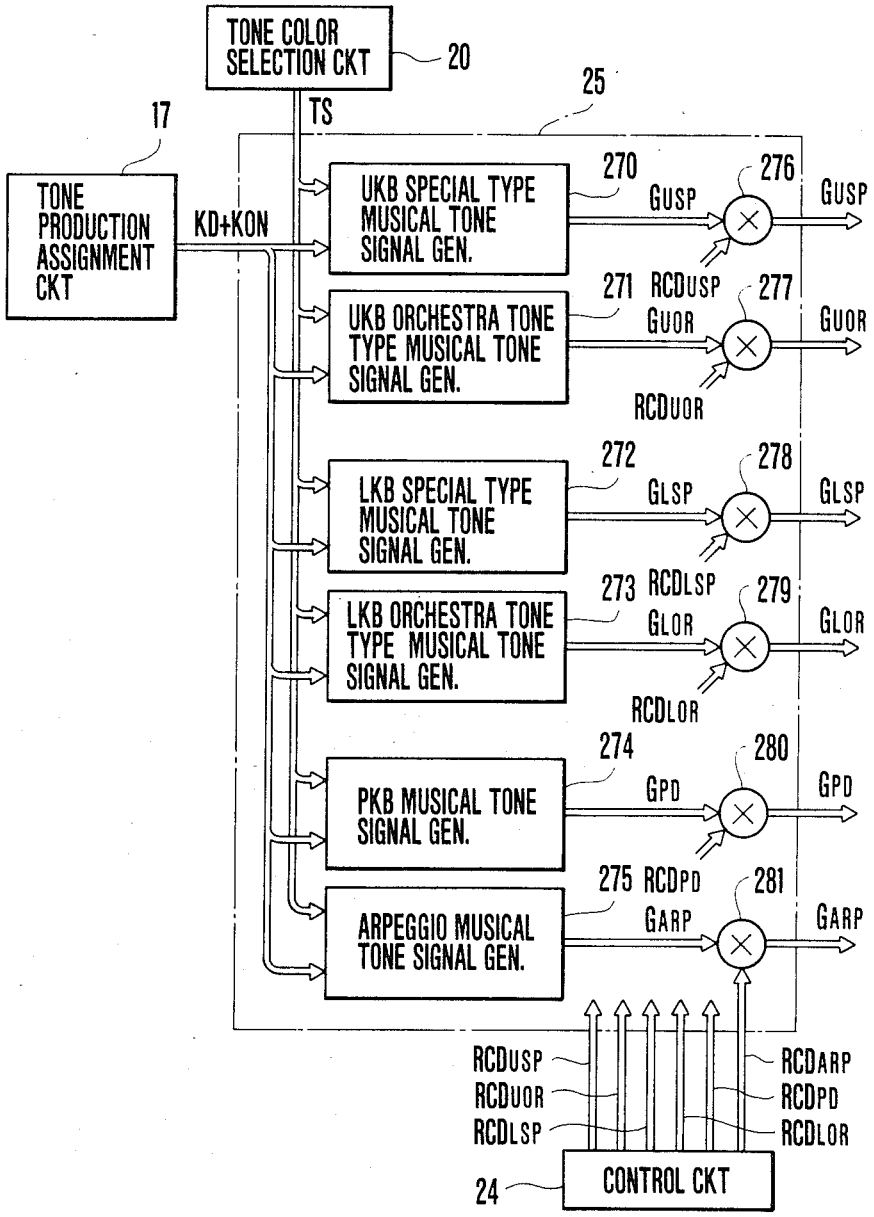
FIG. 20 is a block diagram showing another example of the musical tone signal generator shown in FIG. 10.

FIG. 20 shows another example of the musical tone signal generator 25 in which after forming the musical tone signals for respective musical tone signal forming systems or circuits, the amplitudes of the signals are controlled by the range control informations $RCD_{USP}$ through $RCP_{ARP}$.

The circuit shown in FIG. 20 comprises musical tone signal forming circuits 270 through 275 of the upper keyboard special tone, upper keyboard orchestra tone, lower keyboard special tone, lower keyboard orchestra tone, pedal keyboard tone and arpeggio tone types. The circuits 270 through 275 selectively respond to the key code KD and the key-on signal KON which are outputted, on the time division basis, from the tone production assignment circuit 17, and to the color selection information TS for each musical tone signal generating circuit, for independently producing musical tone signals $G_{USP}$ through $G_{ARP}$ which are supplied to amplitude controlling multipliers 276 through 281 respectively.

To the multipliers 276 through 281 are respectively applied range control informations $RCD_{US}$ through $RCD_{ARP}$ adapted to control the tone volumes form control circuit 24 constructed in the same manner as those shown in FIGS. 11,12 and 15. For this reason, in the multipliers 276 through 281, the amplitudes of the musical tone signals of respective musical tone signal forming circuits are controlled by the informations $RCD_{USP}$ through $RCD_{ARP}$. As a consequence, after synthesizing the outputs of the multipliers 276 through 281 and then supplying the synthesized signal to the sound system 26, the same ensemble effect as that of FIG. 13 can be realized.

As above described, in an electronical musical instrument of this invention, there is provided a selector which determines whether the degree of control effected by a musical tone element according to either one of the control elements including the operation state of an operator controlling the musical tone element and the key touch state of a depressed key is to be emphasized or not. In addition, there is also provided means for inhibiting or suppressing the control effected by the other control element in accordance with the state of selection of the sector.

For this reason, regardless of whether the degree of control by one control element is emphasized or not, it is possible to emphasize the degree of performance by the other control element by the same performance operation. Especially, when the invention is applied to at least one of a plurality of musical tone generating systems, it is possible to obtain an ensemble effect tone rich in musical expression with a simple performance operation.

What is claimed is:

1. An electronic musical instrument comprising:

keyboard means including a plurality of keys;

tone signal generating means for producing a musical tone signal corresponding to a depressed one of said plurality of keys;

a key touch detector for generating a key touch signal concerning a key depression operation of said depressed key;

an operator member for controlling musical tone characteristics of said musical tone signal;

operator detection means for generating an operator detecting signal concerning said operator member when it is operated;

designating means, controlled separately from said operator detection means, for designating one of said key touch signal and said operator detecting signal to be suppressed;

suppression circuit means for suppressing the signal designated by said designating means, an output resultant from the combination of the designated signal suppressed by said suppression means and the non-designated other of said key touch and operator detecting signals being used to modify said musical tone signal outputted from said tone signal generating means; and a sound system for producing a musical tone corresponding to said modified musical tone signal.

2. An electronic musical instrument according to claim 1 wherein said suppression circuit means comprises a gate circuit for inhibiting the delivery of said signal designated by said designating means and for outputting the signal not designated by said designating means.

3. An electronic musical instrument according to claim 1 wherein said suppression circuit means includes a selection circuit including a selector for selecting either one of said key touch signal and said operator detecting signal designated by said designating means.

4. An electronic musical instrument according to claim 1 wherein said suppression circuit means includes a compressor for compressing said designated signal and a synthesizer circuit for synthesizing an output of said compressor and said signal not designated.

5. An electronic musical instrument according to claim 1 wherein said suppression circuit means includes a calculating circuit inputted with said designated signal and a selector for selecting either one of an output of said calculating circuit and said operator detecting signal under the control of said designating means, and a synthesizer circuit for synthesizing an output of said selector and said signal not designated.

6. An electronic musical instrument according to claim 5 wherein said calculating circuit comprises a multiplier.

7. An electronic musical instrument according to claim 1 wherein said suppression circuit means includes a suppression coefficient memory device, and a calculating circuit supplied with said designated signal and an output of said suppression coefficient memory device which is read out from said suppression coefficient memory device in accordance with an output of said designating means.

8. An electronic musical instrument according to claim 7 wherein said calculating circuit comprises a multiplier.

9. An electronic musical instrument according to claim 1 which further comprises a control circuit supplied with said musical tone signal and an output of said suppression circuit means for modifying said musical tone signal with an output of said suppression circuit.

10. An electronic musical instrument according to calim 1 which further comprises a synthesizing circuit for synthesizing an output of said suppression circuit means and either one of said key touch signal and said operator detecting signal being not suppressed by said suppression circuit means, and a control circuit for modifying said musical tone signal with an output of said synthesizer circuit.

11. An electronic musical instrument according to claim 10 wherein said synthesizer circuit comprises an adder and said control circuit comprises a multiplier which multiplies said musical tone signal with an output of said adder.

12. An electronic musical instrument according to claim 1 which further comprises first and second imparting circuits being connected in series, said first imparting circuit modifying said musical tone signal in accordance with either one of said key touch signal and said operator detecting signal being not suppressed by said suppression circuit means, and said second imparting circuit modifying an output of said first imparting circuit in accordance with an output of said suppression circuit means.

13. An electronic musical instrument according to claim 12 wherein each of said first and second imparting circuit comprises a multiplier.

14. An electronic musical instrument according to calim 1 which further comprises a tone color selection circuit, and means for applying an output of said tone color selection circuit to said suppression circuit means and to said tone signal generating means.

15. An electronic musical instrument according to claim 1 wherein said tone signal generating means comprises first and second tone signal generating means being parallelly connected with each other.

16. An electronic musical instrument according to claim 15 wherein said keyboard means comprises an upper keyboard and a lower keyboard, and wherein said first tone signal generating means generates a musical tone signal corresponding to a depressed key of said upper keyboard and said second tone signal generating means generates a musical tone signal corresponding to a depressed key of said lower keyboard.

17. An electronic musical instrument according to claim 15 wherein said first tone signal generating means corresponds to a first tone range of said keyboard and said second tone signal generating means corresponds to a second tone range of said keyboard, and wherein said first tone signal generating means generates a musical tone signal corresponding to a depressed key of said first tone range of the keyboard means, while said second tone signal generating means generates a musical tone signal corresponding to a depressed key of said second tone range.

18. An electronic musical instrument according to claim 1 wherein said operator member comprises one of an expression pedal, a knee lever and a tone volume controller of said electronic musical instrument.

19. An electronic musical instrument according to claim 1 wherein said key touch detector detects at least one of an initial key touch state, an after key touch state, a depressed key speed and a depressed key strength.

20. An electronic musical instrument according to claim 1 wherein said operator detection means comprises an analog-digital converter which converts an analog signal from said operator member into a digital signal, a waveform memory device for storing sampled digital values of an operator detecting signal waveform and for outputting said stored values from memory device storage locations addressed by said digital signal as said operator detecting signal.

21. The electronic musical instrument of claim 1 wherein said designating means selectively designates solely whether or not said operator detecting signal is to be suppressed.

22. In a keyboard electronic musical instrument in which a key touch signal is produced that is indicative of a characteristic of key depression, and in which another musical tone characteristic controlling signal is generated by a separate control member, each of said key touch signal and said other characteristic controlling signal being usable to effectuate control over the characteristics of the musical tone produced by a tone generator within said electronic musical instrument, the improvement comprising:

separate designating means for designating which of said key touch signal or said other characteristic controlling signal should effectuate a relatively lesser degree of control than the other over said musical tone characteristics, and suppression control means for suppressing the designated one of said signals, the output resultant from the combination of the designated signal suppressed by said suppression means and the non-designated other signal being used to modify the characteristics of said produced musical tone.

23. The improvement of claim 22 wherein said separate control member is an expression control member, and wherein said other characteristic controlling signal is an expression signal.

24. The improvement of claim 23 wherein said designating means solely designates whether or not said expression signal should be suppressed by said suppression control means.

25. An electronic musical instrument comprising:

keyboard means including a plurality of keys;

tone signal generating means for producing a musical tone signal corresponding to a depressed one of said plurality of keys;

a key touch detector for generating a key touch signal representing the degree of key depression of said depressed key;

an operator member for controlling musical tone characteristics of said musical tone signal;

operator detection means for generating an operator detecting signal concerning said operator member when it is operated;

designating means for designating one of said key touch signal and said operator detecting signal to be suppressed;

suppression circuit means for suppressing the signal designated by said designating means;

means for modifying said musical tone signal outputted from said tone signal generating means by using an output resultant from the combination of the designated signal suppressed by said suppression means and the non-designated other of said key touch and operator detecting signals; and a sound system for producing a musical tone corresponding to said modified musical tone signal.

* * * * *